US012110754B2

(12) United States Patent
Jones

(10) Patent No.: US 12,110,754 B2
(45) Date of Patent: Oct. 8, 2024

(54) VARIABLE INTENSITY AND SELECTIVE PRESSURE ACTIVATED JAR

(71) Applicant: HydraShock, LLC, Clinton, OK (US)

(72) Inventor: Kevin Dewayne Jones, Clinton, OK (US)

(73) Assignee: HydraShock, L.L.C., Clinton, OK (US)

( * ) Notice: Subject to any disclaimer, the term of this patent is extended or adjusted under 35 U.S.C. 154(b) by 64 days.

(21) Appl. No.: 17/971,951

(22) Filed: Oct. 24, 2022

(65) Prior Publication Data

US 2023/0047958 A1 Feb. 16, 2023

Related U.S. Application Data

(63) Continuation-in-part of application No. 16/380,017, filed on Apr. 10, 2019, now Pat. No. 11,480,022, (Continued)

(51) Int. Cl.

| | |
|---|---|
| ***E21B 31/113*** | (2006.01) |
| ***E21B 23/04*** | (2006.01) |
| ***E21B 23/10*** | (2006.01) |

(52) U.S. Cl.

CPC ..... *E21B 31/113* (2013.01); *E21B 23/04* (2013.01); *E21B 23/10* (2013.01)

(58) Field of Classification Search

CPC ..... E21B 23/04; E21B 23/10; E21B 31/113
See application file for complete search history.

(56) References Cited

U.S. PATENT DOCUMENTS

| | | | |
|---|---|---|---|
| 3,020,964 | A | 2/1962 | Graham et al. |
| 3,535,056 | A | 10/1970 | Harbison |

(Continued)

FOREIGN PATENT DOCUMENTS

| | | | |
|---|---|---|---|
| RU | 166931 | U1 | 12/2016 |
| WO | 2008146012 | A2 | 12/2008 |
| WO | 2013175189 | A2 | 11/2013 |

OTHER PUBLICATIONS

Korean Intellectual Property Office, "Patent Cooperation Treaty PCT International Search Report", Jun. 9, 2017, 3 pages, Republic of Korea.

(Continued)

*Primary Examiner* — Caroline N Butcher
(74) *Attorney, Agent, or Firm* — Tomlinson McKinstry, P.C.

(57) ABSTRACT

A jarring tool used to dislodge a stuck tubular string or bottom hole assembly within an underground wellbore. A funnel element is placed underground either within, or as part of, a tubular string. A deformable ball may be seated within the funnel element to block fluid from passing within the tubular string. Hydraulic pressure may build within the tubular string until it exceeds the pressure the ball can withstand. This will cause the ball to deform and be expelled through the funnel element. With no ball to block its flow, fluid will be rapidly released through the funnel element. The rapid release of fluid will cause a powerful jarring or jolting to the tubular string or bottom hole assembly. Deformed balls may be captured in a cartridge chamber installed within the drill string and sized to create turbulent fluid flow within the drill string.

22 Claims, 21 Drawing Sheets

Related U.S. Application Data which is a continuation of application No. 15/443,070, filed on Feb. 27, 2017, now Pat. No. 10,267,114.

(60) Provisional application No. 63/300,690, filed on Jan. 19, 2022, provisional application No. 62/301,398, filed on Feb. 29, 2016.

(56) References Cited

U.S. PATENT DOCUMENTS

| | | | |
|---|---|---|---|
| 4,341,272 | A | 7/1982 | Marshall |
| 4,889,199 | A | 12/1989 | Lee |
| 5,797,454 | A | 8/1998 | Hipp |
| 6,182,775 | B1 | 2/2001 | Hipp |
| 6,290,004 | B1 | 9/2001 | Evans |
| 6,318,470 | B1 | 11/2001 | Chang et al. |
| 6,681,860 | B1 | 1/2004 | Yokley et al. |
| 6,923,255 | B2 | 8/2005 | Lee |
| 8,297,365 | B2 | 10/2012 | Dove |
| 8,365,818 | B2 | 2/2013 | Schultz et al. |
| 8,561,688 | B2 | 10/2013 | Evans |
| 9,228,402 | B2 | 1/2016 | Strilchuk |
| 2009/0166026 | A1 | 7/2009 | Akselberg |
| 2009/0283322 | A1 | 11/2009 | Dove |
| 2014/0060854 | A1 | 3/2014 | Baudoin |
| 2015/0136416 | A1 | 5/2015 | Churchill |
| 2015/0226031 | A1 | 8/2015 | Hekelaar |
| 2017/0247969 | A1* | 8/2017 | Jones ..... E21B 23/10 |

OTHER PUBLICATIONS

Korean Intellectual Property Office, "Patent Cooperation Treaty PCT Written Opinion of the International Searching Authority", Jun. 9, 2017, 15 pages, Republic of Korea.

International Bureau, "International Application Status Report", May 24, 2013, 2 pages.

International Bureau, "PCT International Preliminary Report on Patentability", Nov. 25, 2014, 6 pages, Geneva, Switzerland.

Patent Cooporation Treaty, "Written Opinion of the International Searching Authority", Undated, 12 pages, Munich, Germany.

Federal Service for Intellectual Property (Rospatent), Federal Institute of Industrial Property (FIPS), "Patent Search Report", Apr. 3, 2020, 4 pages, Russia.

Patent Office of the Russian Federation, Federal Institute of Industrial Property, "Office Action (Enquiry)", Jun. 3, 2020, 9 pages, Russia.

* cited by examiner

VARIABLE INTENSITY AND SELECTIVE PRESSURE ACTIVATED JAR

SUMMARY

The present invention is directed to a method of using a drill string configured for use within an underground environment. The method comprises the step of incorporating a sub having a fluid passage formed therein into the drill string, the sub having an elongate cartridge installed within the fluid passage, the cartridge retained within the fluid passage, but movable relative to the sub and having an outer surface comprising a concentric portion joined to a non-concentric portion. The method further comprises the steps of lowering a portion of the drill string carrying the sub into the underground environment, and generating fluid flow within the drill string and around the elongate cartridge such that the fluid flow causes the elongate cartridge to oscillate within the sub.

The present invention is also directed to a kit. The kit comprises a funnel sub having opposed first and second surfaces joined by a first fluid passage, the first fluid passage having a seat formed therein, and at least one deformable ball, each of which is sized, in its undeformed state, to be blocked from passing through the first fluid passage by the seat. The kit further comprises a receiver sub having opposed first and second surfaces joined by a second fluid passage, and an elongate cartridge sized for removable installation within the second fluid passage of the receiver sub. The cartridge has a pair of isolated cartridge chambers formed therein, in which one of the isolated cartridge chambers is configured to receive and retain deformed balls expelled from the funnel sub. The cartridge further has an outer surface comprising a concentric portion joined to a non-concentric portion.

The present invention is further directed to a jarring tool. The tool comprises a funnel sub having opposed first and second surfaces joined by a first fluid passage, the first fluid passage having a seat formed therein, and a receiver sub attached to the funnel sub and having opposed first and second surfaces joined by a second fluid passage. The tool further comprises an elongate cartridge installed within at least a portion of the second fluid passage of the receiver sub such that the cartridge is retained within the receiver sub but is movable relative to the receiver sub.

The cartridge comprises a first cartridge chamber formed within the cartridge and opening towards the first surface of the receiver sub, the first cartridge chamber having a single port formed therein. The cartridge further comprises a second cartridge chamber formed therein that opens towards the second surfaces of the receiver sub. The second cartridge chamber is isolated from the first cartridge chamber and has at least two ports formed therein. The cartridge further comprises a flange formed at the end of the cartridge and surrounding the second cartridge chamber. An outer surface of the flange comprises a concentric portion joined to a non-concentric portion.

DETAILED DESCRIPTION

Figure 1:
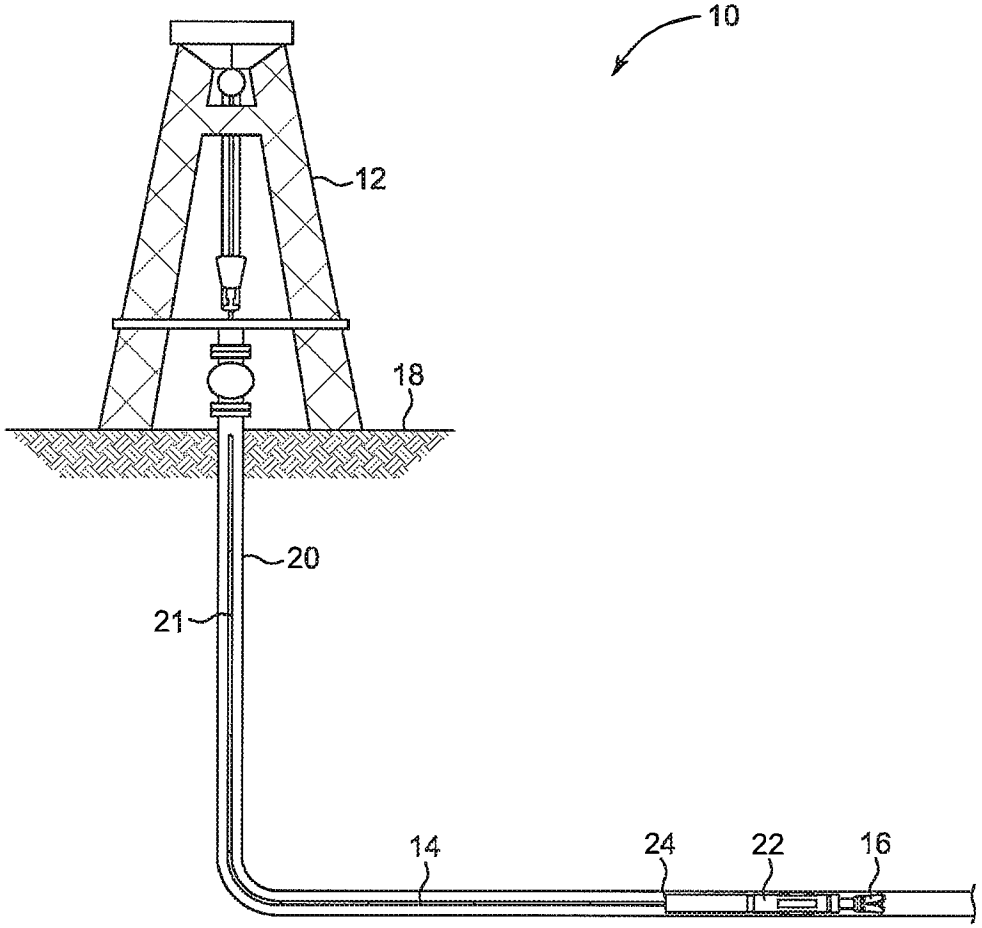
FIG. 1 is a schematic view of a drilling system formed from a series of interconnected rigid pipe sections.

In oil and gas drilling operations, there may arise a need to dislodge a stuck drill string within a wellbore by imparting a jarring impact force on the drill string or the bottom hole assembly. FIG. 1 shows a schematic view of a drilling system 10 used in oil and gas drilling operations. The drilling system 10 comprises surface equipment 12, an elongate tubular string or drill string 14, and a drill bit 16. The surface equipment 12 sits on a ground surface 18. The drill string 14 and the drill bit 16 are shown underground in a wellbore 20. The drill string 14 is made up of a plurality of rigid pipe sections 21 attached end to end. The pipe sections 21 may comprise jointed pipe or drill pipe. A drill pipe drill string 14 is typically used when drilling the initial wellbore 20 or when drilling deep wells because it can typically withstand great amounts of pressure. A jointed pipe drill string 14 may be used when drilling shallow wells or when performing well completion operations. A jointed pipe drill string 14 may not be capable of withstanding as much pressure as a drill pipe drill string 14.

The drilling system 10 works to advance the drill string 14 and the drill bit 16 down the wellbore 20 during drilling operations by rotating the drill string 14 and the drill bit 16. A bottom hole assembly 22 is connected to a terminal end 24 of the drill string 14 prior to the drill bit 16. The bottom hole assembly 22 may comprise one or more tools used in drilling operations, such as mud motors, telemetry equipment, hammers, etc.

Figure 2:
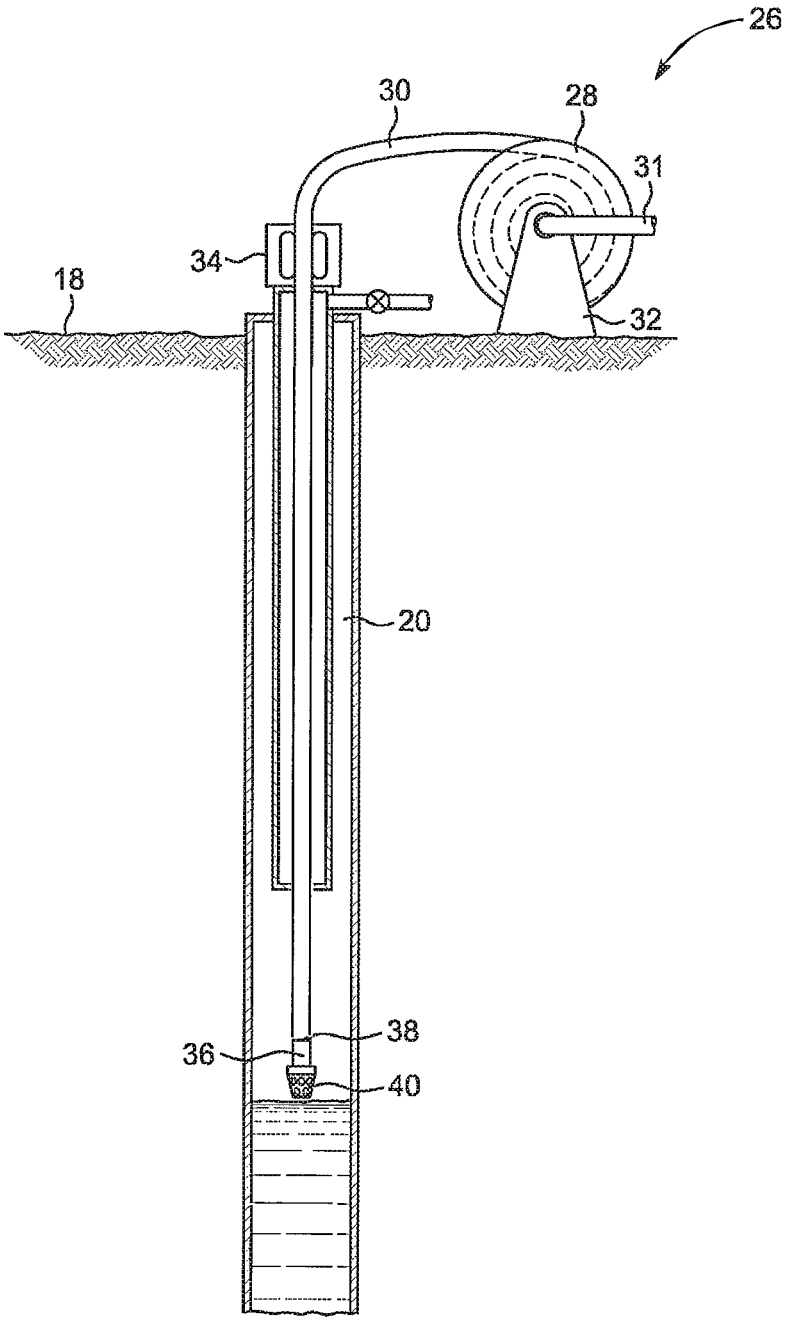
FIG. 2 is a schematic view of a drilling system formed from coiled tubing.

FIG. 2 shows a schematic view of a coiled tubing drilling system 26 used in oil and gas drilling operations. The coiled tubing system 26 comprises surface equipment positioned at the ground surface 18. The surface equipment comprises a spool 28 of an elongate tubular string or coiled tubing 30 attached to a reel 32. The coiled tubing 30 is generally a very long metal pipe that may be between 1-4 inches in diameter. The coiled tubing 30 is advanced along the wellbore 20 using an injector head 34. A bottom hole assembly 36 may be attached to a terminal end 38 of the coiled tubing 30. A drill bit 40 is attached to the bottom hole assembly 36 within the wellbore 20, in FIG. 2.

The coiled tubing system 26 may be used to drill shallow wells or to perform well completion operations. Unlike the drill pipe or jointed pipe drill string 14, the coiled tubing drill string 30 does not rotate and is made up of a continuous string of pipe. This allows fluid to be continuously supplied to the wellbore 20 during operation.

A device capable of producing a jarring impact force on a stuck drill string 14 or coiled tubing drill string 30 is typically referred to as a "jar". Jars known in the art operate mechanically or hydraulically. These jars contain moving parts and must be set or cocked to operate. In some cases, backward movement of the drill string 14 is required to set the jar. In coiled tubing 26 operations, the movement required to set the jar causes the coiled tubing 30 to move back and forth over the injector head 34 at the ground surface 18. This may cause the coiled tubing 30 to break down. In other cases, the jar may be set prior to drilling operations. In such instance, an operator runs the risk of the jar releasing and firing unintentionally.

The present invention is directed to a variable intensity and selective pressure activated jar that may be used with a drill pipe, jointed pipe, or coiled tubing drill string 14, 30. The jar of the present invention is described herein with reference to three embodiments, 100, 200, and 300. The jar 100, shown with reference to FIGS. 3-13, may be used with a drill pipe drill string 14. The jar 100 may be thread directly into a drill pipe drill string 14 prior to drilling the wellbore 20.

The jar 200, shown with reference to FIGS. 14-23, may be incorporated into a jointed pipe drill string 14. The jar 200 may be incorporated into the jointed pipe drill string 14 after the drill string is already within the wellbore 20.

The jars 100 and 200 may be threaded or incorporated into any portion of the drill string 14 desired. However, preferably the jars 100 and 200 are threaded or incorporated into the bottom hole assembly 22 uphole from the motor and telemetry equipment. The jars 100 and 200 are most effective the closer they are to the drill bit 16.

Figure 24:
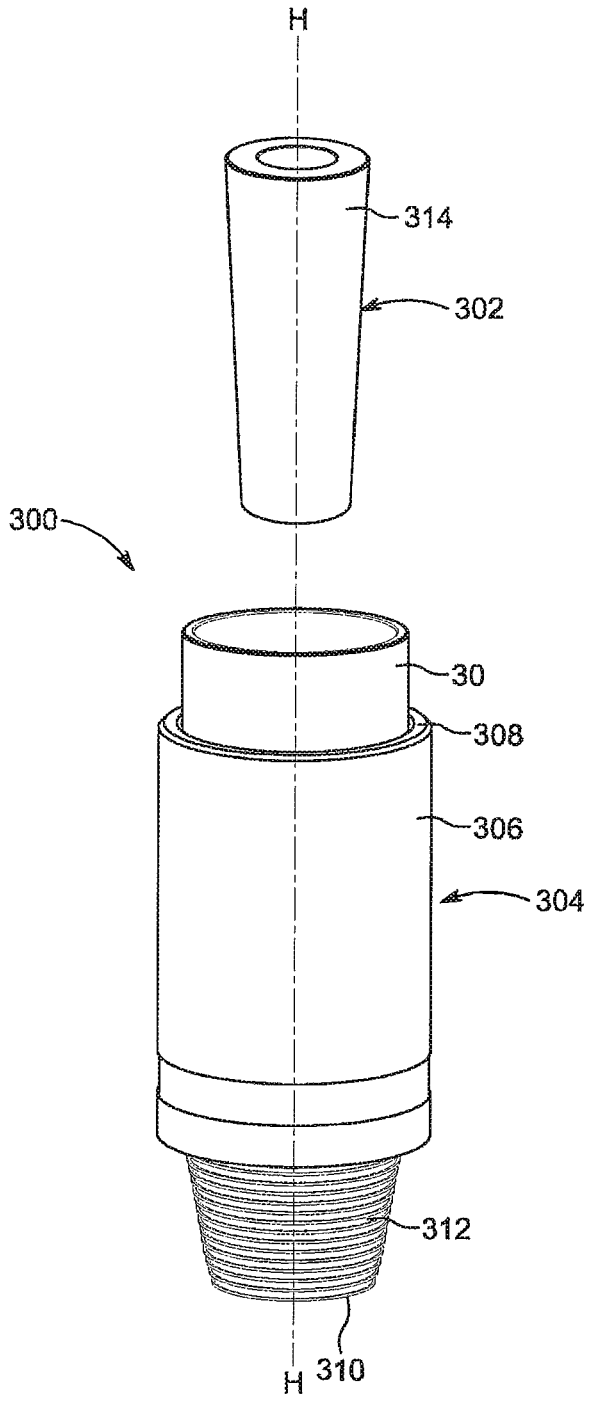
FIG. 24 is an exploded view of a third embodiment of the jar.
Figure 25:
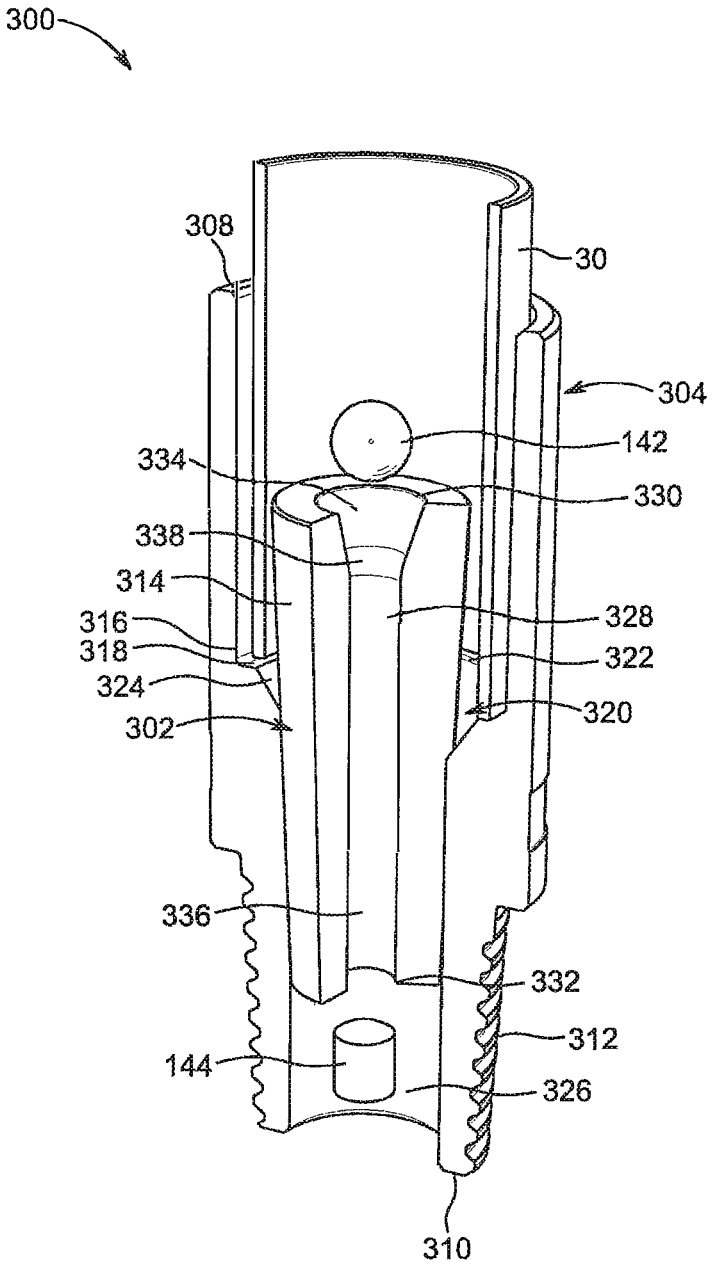
FIG. 25 is a perspective view of the jar shown in FIG. 24 in an assembled configuration. Portions of the funnel element and collar element have been cut away, for better display.
Figure 26:
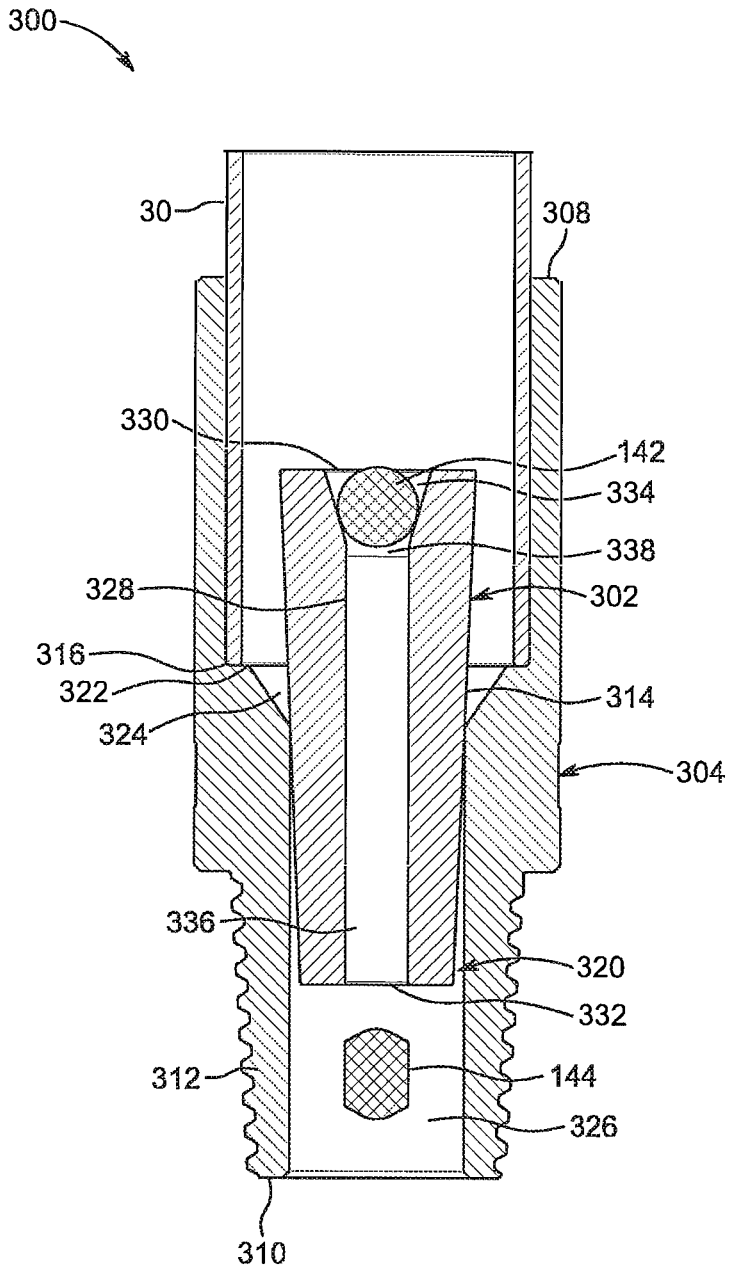
FIG. 26 is a cross-sectional view of the jar shown in FIG. 24 in an assembled configuration. The cross-section is taken along line H-H shown in FIG. 24.

The jar 300, shown with reference to FIGS. 24-26, may be used with the coiled tubing system 26. The jar 300 may be attached to the terminal end 38 of the coiled tubing drill string 30 directly above the bottom hole assembly 36. As described herein, the jars 100, 200, and 300 use the same method to dislodge the drill string 14, 30 or bottom hole assembly 22, 36 from its stuck point within the wellbore 20.

Figure 3:
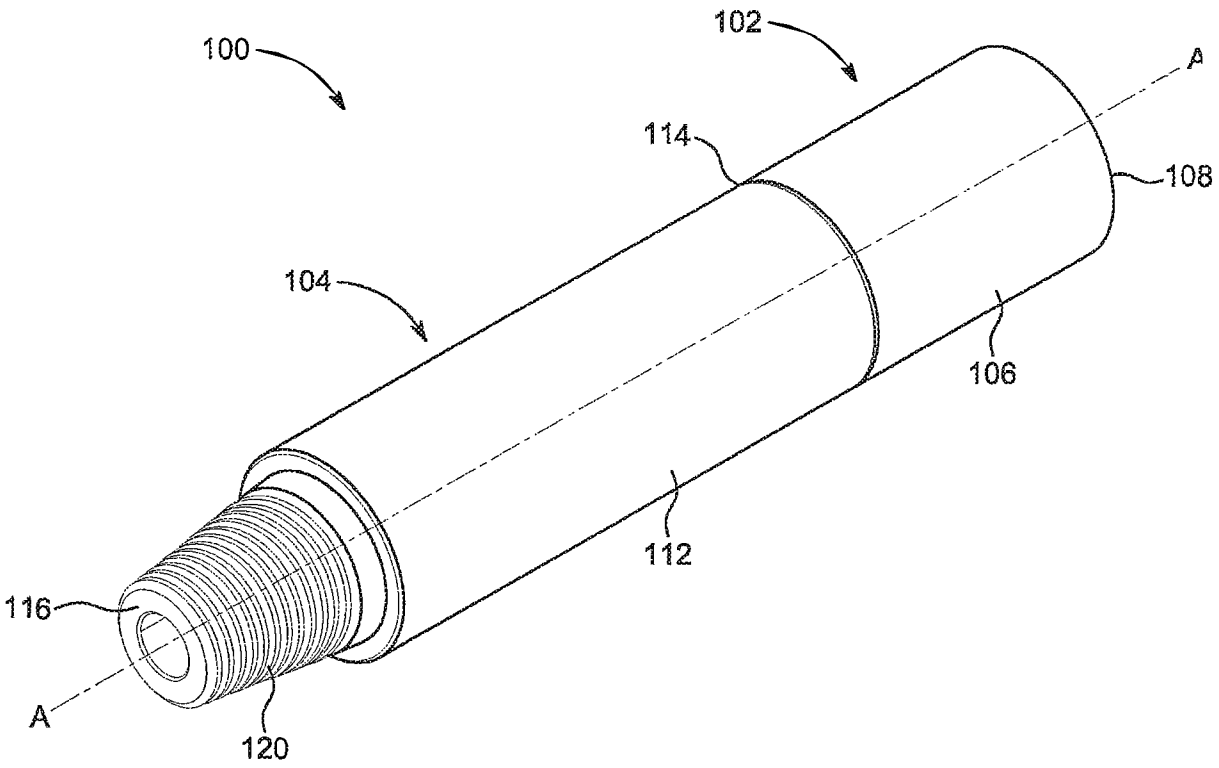
FIG. 3 is perspective view of a jar of the present invention.
Figure 4:
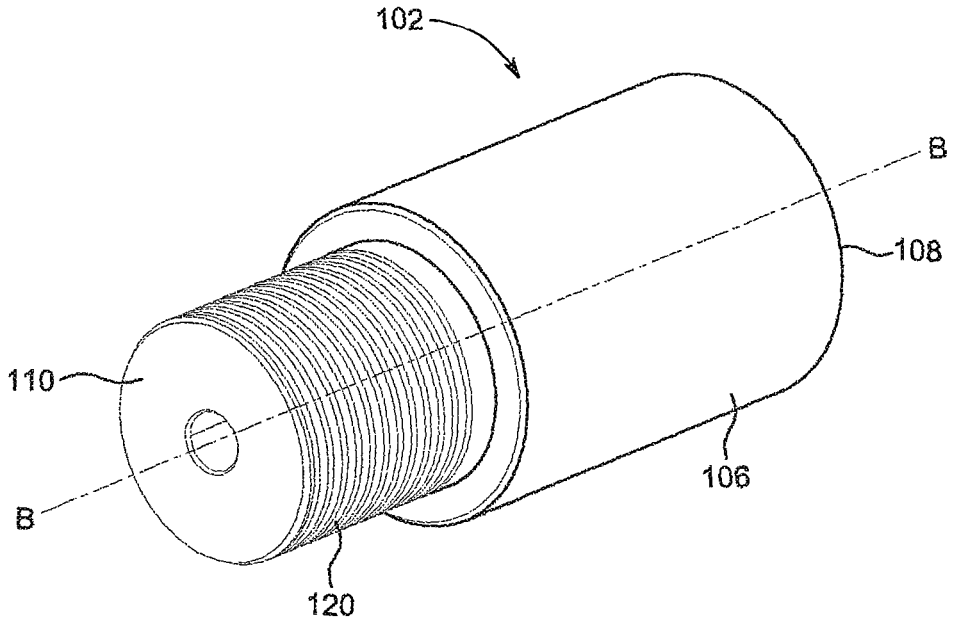
FIG. 4 is a perspective view of a funnel sub of the jar of FIG. 3.

Turning now to FIGS. 3-13, the jar 100 for use with a drill pipe drill string 14 is shown in more detail. The jar 100 comprises a funnel sub 102 and a receiver sub 104. The funnel sub 102 has a cylindrical outer body 106 having a first end 108 and an opposite second end 110 (FIG. 4). The funnel sub 102 opens at the first end 108 and at the second end 110. The receiver sub 104 has an elongate cylindrical outer body 112 having a first end 114 and an opposite second end 116. The receiver sub 104 opens at the first end 114 and at the second end 116.

Figure 5:
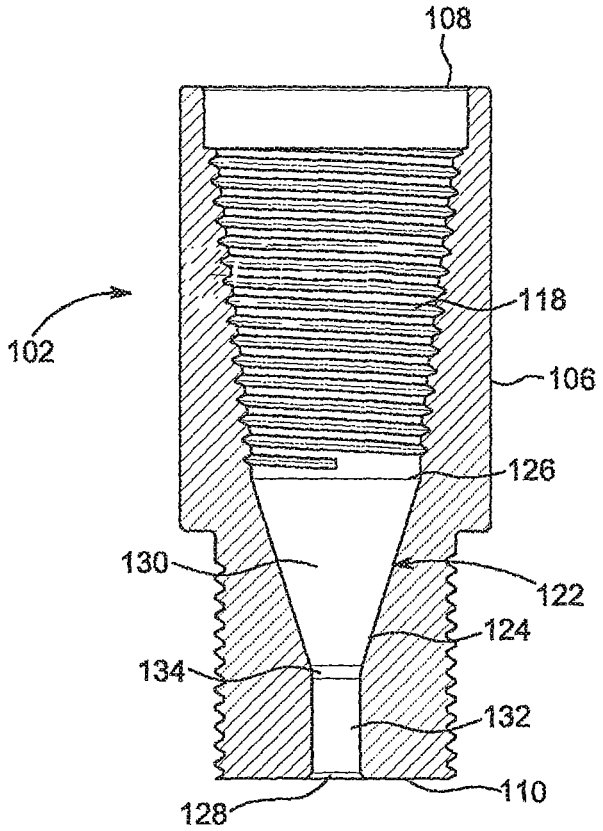
FIG. 5 is a cross-section of the funnel sub shown in FIG. 4, taken along a plane that contains line B-B.
Figure 6:
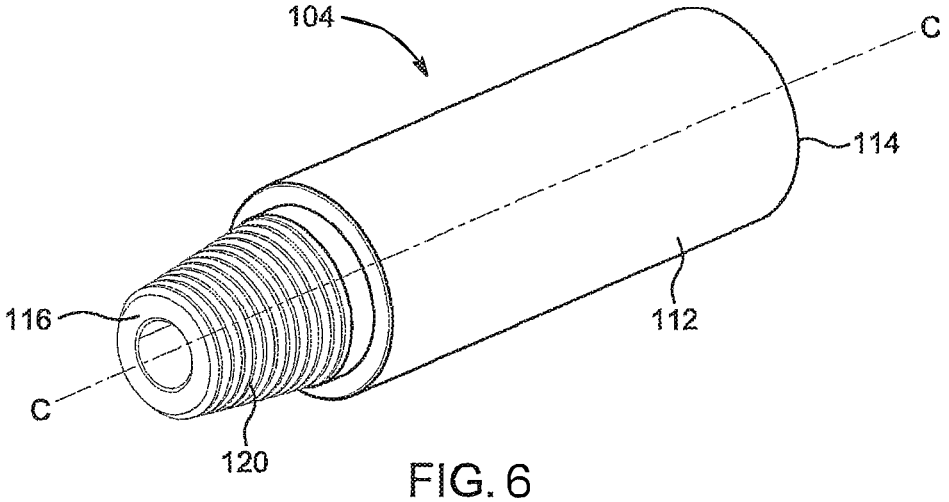
FIG. 6 is a perspective view of a receiver sub of the jar of FIG. 3.
Figure 7:
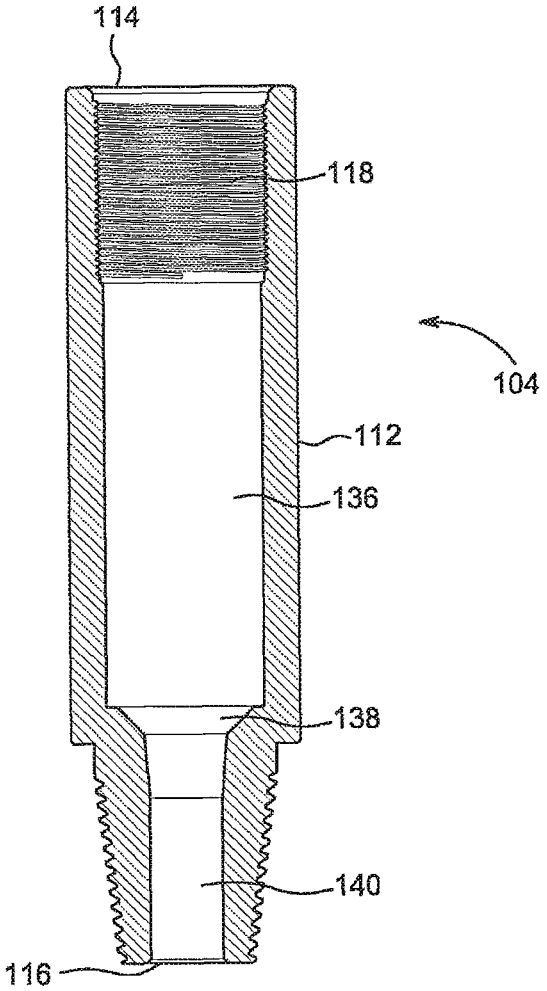
FIG. 7 is a cross-section of the receiver sub shown in FIG. 6, taken along a plane that contains line C-C.

Both the first end 108 of the funnel sub 102 and the first end 114 of the receiver sub 104 have internal threads 118 formed therein (FIGS. 5 and 7). Likewise, both the second end 110 of the funnel sub 102 and the second end 116 of the receiver sub 104 have external threads 120 formed thereon (FIGS. 4 and 6). The second end 110 of the funnel sub 102 threads into the first end 114 of the receiver sub 104 (FIG. 3). Together, the funnel sub 102 and the receiver sub 104 may thread into the drill pipe drill string 14.

The jar 100 is in fluid communication with the drill string 14 when the jar 100 is threaded directly into the drill pipe drill string 14. The outer body 106 and 112 of the jar 100 will contact the sides of the wellbore 20, like the rest of the drill string 14, once the drill string is lowered into the wellbore 20. The jar 100 will also rotate with the drill string 14 during drilling operations.

Turning now to FIG. 5, a cross-section of the funnel sub 102 is shown. The cross-section is taken along a plane that contains line B-B show in FIG. 4. A funnel element 122 is formed inside of the funnel sub 102 below the internal threads 118. The funnel element 122 has a fluid passage 124 that opens at a first surface 126 and an opposite second surface 128. The first surface 126 opens into an enlarged and recessed bowl 130. The bowl 130 tapers inwardly and connects with a narrow neck 132 that opens at the second surface 128 of the funnel element 122. The second surface 128 of the funnel element 122 opens at the second end 110 of the funnel sub 102. The bowl 130 has the shape of a frustum of a right circular cone having a slant angle of between 15 and about 20 degrees. Preferably this angle is 17.5 degrees. The connection between the bowl 130 and the narrow neck 132 forms a seat 134.

Fluid from the drill pipe drill string 14 may enter the first end 108 of the funnel sub 102, pass through the funnel element 122 and into the receiver sub 104. A cross-section of the receiver sub 104 is shown in FIG. 7. The cross-section is taken along a plane that contains line C-C shown in FIG.

Figure 8:
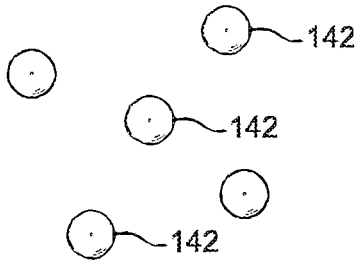
FIG. 8 shows a plurality of deformable balls for use with the jar. The balls are shown in an undeformed state.
Figure 9:
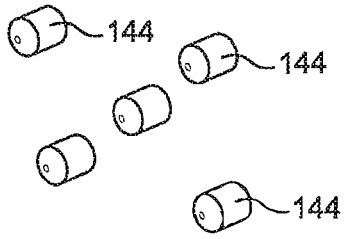
FIG. 9 shows a plurality of deformed balls created by use of the jar.

6. The receiver sub 104 has a receiver chamber 136 that opens at a bottom surface 138 into a fluid passage 140. The fluid passage 140 continues into the drill string 14. The jar 100 itself contains no moving parts. When the jar 100 is not in use, it simply serves as a conduit for fluid to pass through in the drill string 14 or bottom hole assembly 22. The jar 100 is activated by a deformable ball 142. The ball 142 and a deformed ball 144 are shown in FIGS. 8-9.

Figure 10:
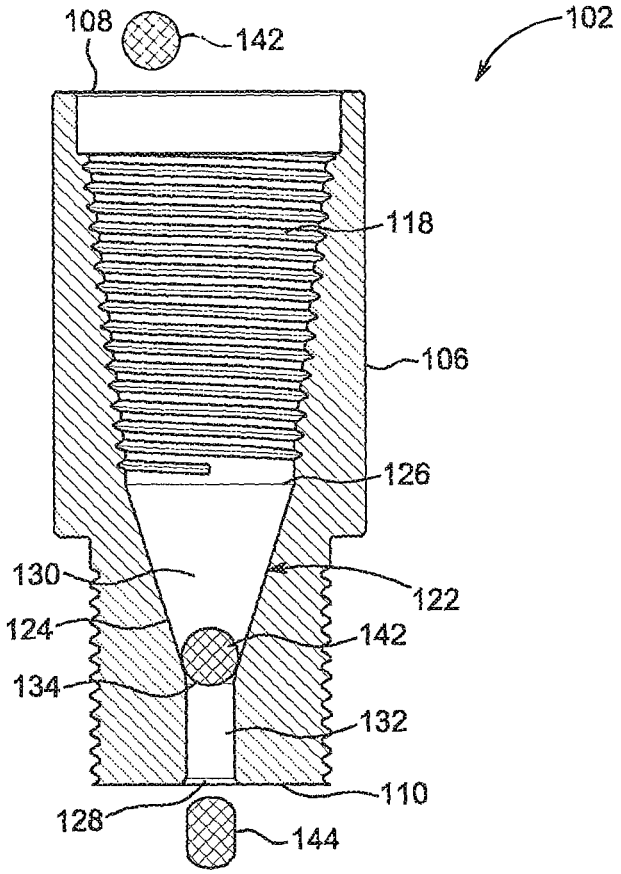
FIG. 10 shows how the deformable ball is positioned relative to the funnel sub of FIG. 5 at successive stages of the jarring process.

Referring now to FIG. 10, the ball 142 is lowered or pumped down the drill string 14 to activate the jar 100. The diameter of the ball 142 is greater than the diameter of the seat 134 formed in the funnel element 122. Thus, the ball 142 will stop movement through the drill string 14 when it reaches the seat 134 formed in the funnel element 122. When the ball 142 is in a seated position within the funnel element 122, the ball 142 will block fluid from flowing between the funnel sub 102 and the receiver sub 104.

If fluid is continually pumped down the drill string 14, hydraulic pressure will build behind the ball 142 and within the portion of the drill string 14 uphole from the funnel sub 102. As hydraulic pressure builds within the drill string 14, the drill string will start to elongate. Eventually, the hydraulic pressure pushing on the ball 142 will exceed the amount of pressure the ball 142 can withstand. This will cause the ball 142 to deform and be expelled through the narrow neck 132 of the funnel element 122. The deformed ball 144 may be expelled through the funnel element 122 at a rate of 22,000-23,000 feet/second.

As the deformed ball 144 is expelled through the funnel element 122, fluid behind the ball will rapidly release through the narrow neck 132 of the funnel element 122. Fluid will rapidly release due to the significant amount of hydraulic pressure built up in the drill string 14. The rapid release of fluid will cause a dynamic event within the wellbore 20. The dynamic event is characterized by a sheer wave throughout the drill string 14 that causes a powerful jarring or jolting of the drill string 14 within the wellbore 20. The sheer wave is the result of the drill string 14 returning back to its natural state after being elongated by hydraulic pressure. The jarring or jolting of the drill string 14 works to dislodge the drill string 14 from its stuck point within the wellbore 20.

The jar 100 is capable of bi-directional jarring. This means that the dynamic event may jar the drill string 14 uphole from the jar 100 and the drill string or bottom hole assembly 22 downhole from the jar 100. The ease of dislodging the drill string 14 or bottom hole assembly 22 from its stuck point may be increased by using the surface equipment 12 to push or pull on the drill string 14 at the same time the jarring or jolting of the drill string takes place.

If the first dynamic event does not dislodge the drill string 14 or bottom hole assembly 22 from its stuck point, a second ball 142 may be pumped down the drill string 14 until it lands on the seat 134. Hydraulic pressure may again build behind the ball 142 until the pressure exceeds that which the ball can withstand and deforms the ball 142. The deformed ball 144 is expelled through the funnel element 122 causing the rapid release of fluid and a second dynamic event within the wellbore 20. This process may be repeated as many times as needed until the drill string 14 is dislodged from its stuck point within the wellbore 20. The use of the balls 142 to activate the jar 100 negates the need to set or cock the jar prior to firing. Thus, the jar 100 cannot be unintentionally fired downhole.

The balls 142 used to activate the jar 100 may have varying diameters. The greater the diameter of the ball 142, the greater the hydraulic pressure needed to deform the ball. The greater the hydraulic pressure built within the drill string 14, the more powerful the dynamic event. Thus, the greater the diameter of the ball 142, the more powerful the dynamic event or jarring of the drill string 14 and bottom hole assembly 22 that will take place within the wellbore 20.

The balls 142 are preferably solid and made of nylon, but can be made out of any material that is capable of deforming under hydraulic pressure and withstanding high temperatures within the wellbore 20. The balls 142 may also be porous and coated in a nano-particulate matter, the contents of which are a trade secret. The matter helps add friction between the ball 142 and the funnel element 122. The greater the friction between the ball 142 and the funnel element 122, the more hydraulic pressure will be required to extrude the ball through the funnel element. Due to this, the nano-particulate matter helps control the rate at which the deformed balls 144 are extruded through the funnel element 122.

In operation, an operator in charge of activating the jar 100 is typically provided with a set of balls 142 varying in diameter. The operator may start by first sending a control ball 142 down the drill string 14 to activate the jar 100. The control ball 142 is used to gain information about the conditions within the wellbore 20. This is important because each wellbore 20 may vary in depth, and the depth of the jar 100 within the wellbore 20 at the time the drill string 14 becomes stuck may vary. Due to this, the same size balls 142 may extrude at different pressures within each wellbore 20.

The operator may use any size ball 142 as a control ball. For example, the operator may choose the ball 142 with the smallest diameter as the control ball. This may be because the ball 142 with the smallest diameter will create the least powerful dynamic event, because it deforms under the least amount of hydraulic pressure. Once the control ball 142 has been extruded through the funnel element 122 and the jarring event takes place, the operator may try to move the drill string 14 within the wellbore 20. The operator can then determine what size ball 142 to use next based on the amount of movement of the drill string 14. For example, the control ball 142 alone may dislodge the drill string 14 or bottom hole assembly 22 from its stuck point. Alternatively, the drill string 14 may not move at all after using the control ball 142. In such case, it might be useful to jump up several sizes and use a ball 142 that creates a more powerful dynamic event within the wellbore 20. A larger sized ball 142 may be used as the control ball 142 if the operator knows beforehand that the drill string 14 will require a larger jarring event to attempt to dislodge it from its stuck point.

The operator may determine the amount of pressure required within the wellbore 20 to extrude each of the different sized balls 142 by watching the pressure gage at the ground surface 18. The pressure will build while the ball 142 is seated within the funnel element 122 and the pressure will drop once the deformed ball 144 is extruded. Once the operator determines the pressure required to deform and extrude the control ball 142 through the funnel element 122, the operator can determine the approximate amount of pressure required to deform and extrude the other sized balls.

Figure 11:
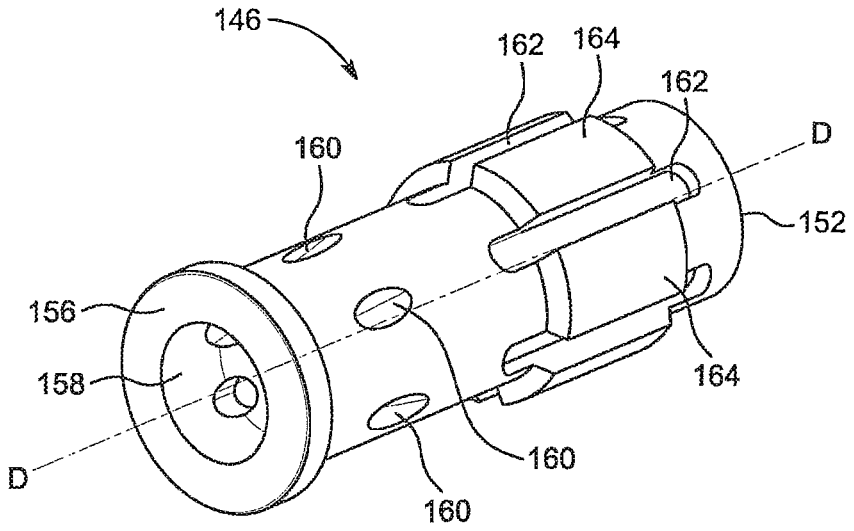
FIG. 11 is a perspective view of an elongate cartridge for use with the jar of FIG. 3.
Figure 12:
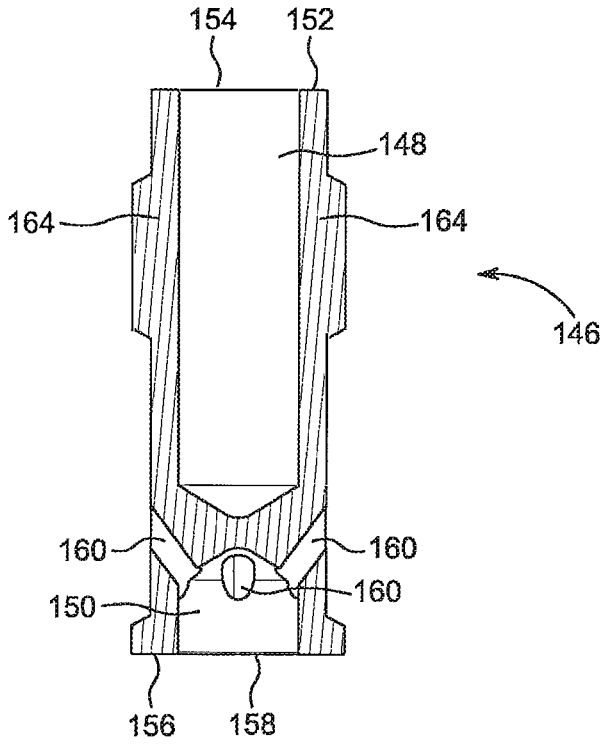
FIG. 12 is a cross-section of the cartridge shown in FIG. 11, taken along a plane that contains line D-D.

Turning now to FIGS. 11-12, an elongate cartridge 146 is shown. A cross-section of the elongate cartridge 146 is shown in FIG. 12. The cross-section is taken along a plane that includes line D-D shown in FIG. 11. The elongate cartridge 146 is used to catch the deformed balls 144 after they are expelled through the funnel element 102. The elongate cartridge 146 may be installed in the receiver chamber 136 of the receiver sub 104. The elongate cartridge 146 comprises a first cartridge chamber 148 and a second cartridge chamber 150 that are longitudinally offset from one another. The first cartridge chamber 148 opens at a first end 152 of the elongate cartridge 146 via a port 154. The second cartridge chamber 150 opens at a second end 156 of the elongate cartridge 146 via a fluid opening 158. The second cartridge chamber 150 has at least two ports 160 that open on the sides of the elongate cartridge 146. The ports 160 are in fluid communication with the receiver chamber 136.

Figure 13:
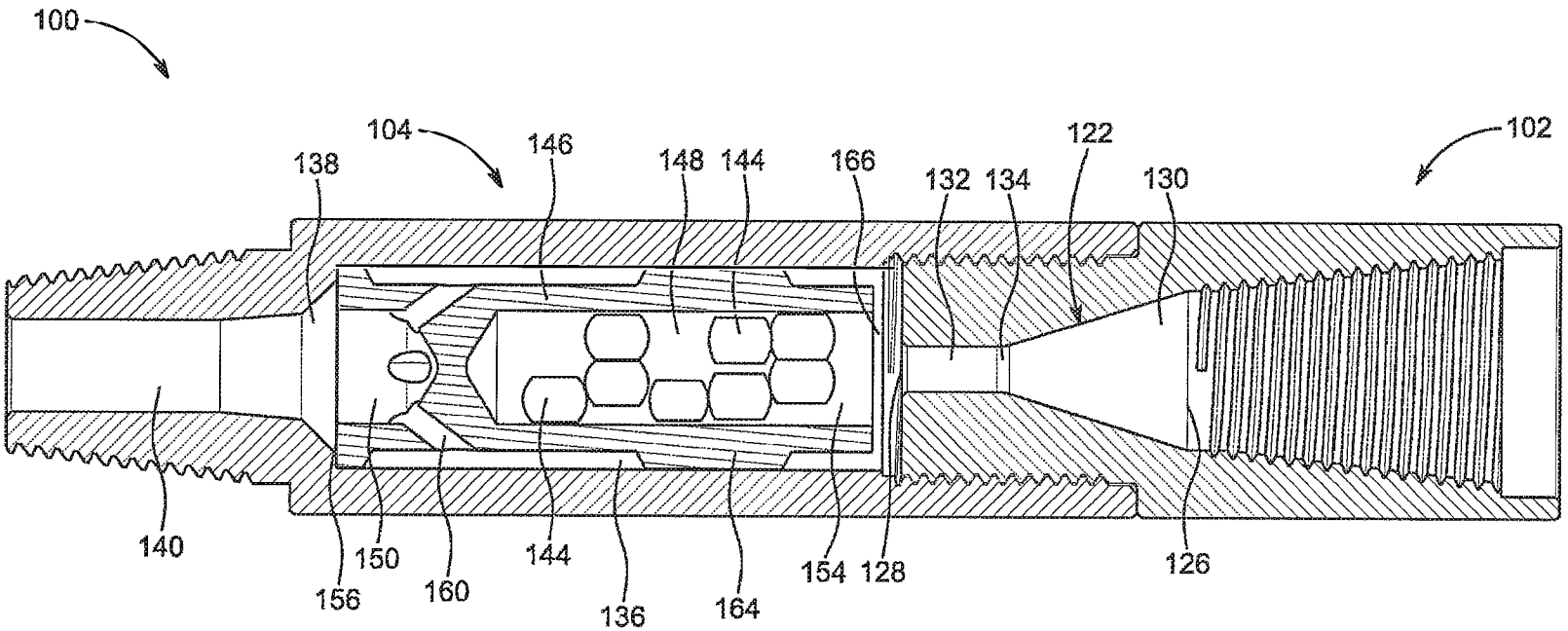
FIG. 13 is a cross section of the jar shown in FIG. 3, taken along a plane that contains line A-A. The cartridge shown in FIG. 11 has been installed within the receiver sub. Deformed balls are shown within the cartridge.

With reference to FIG. 13, a cross-section of the jar 100 is shown. The cross-section is taken along a plane that includes line A-A shown in FIG. 3. The elongate cartridge 146 is installed in the receiver chamber 136 of the receiver sub 104 such that the second end 156 of the elongate cartridge 146 engages with the bottom surface 138 of the receiver chamber 136. The port 154 of the first cartridge chamber 148 is situated directly below the second surface 128 of the funnel element 122. Deformed balls 144 that are expelled out of the funnel element 122, pass through the port 154, and are contained within the first cartridge chamber 148.

A series of fluid lanes 162 (FIG. 11) are also formed on the outer surface of the elongate cartridge 146 proximate its first end 152. The fluid lanes 162 help direct fluid within the receiver chamber 136 of the receiver sub 104 into the ports 160 that lead into the second cartridge chamber 150. An elongate shoulder 164, shown in FIGS. 11 and 13, is formed in between each fluid lane 162. The elongate shoulders 164 engage with the wall of the receiver chamber 136 to help direct fluid into each fluid lane 162.

Continuing with FIG. 13, the elongate cartridge 146 is installed in the receiver chamber 136 such that a small space 166 exists between the second surface 128 of the funnel element 122 and the port 154 of the first cartridge chamber 148. The space 166 is large enough to allow fluid to flow into the receiver chamber 136, but small enough to keep the deformed balls 144 from flowing into the receiver chamber. The deformed balls 144 can only pass from the funnel element 122 into the first cartridge chamber 148. The space 166 and the fluid lanes 162 create zones of clearance for fluid to pass from the receiver chamber 136 into the second cartridge chamber 150.

Fluid may flow from the funnel element 122 through the space 166 and into the receiver chamber 136. The elongate shoulders 164 of the elongate cartridge 146 direct fluid into the fluid lanes 162. The fluid lanes 162 direct fluid from the receiver chamber 136 into the ports 160 formed in the second cartridge chamber 150. Fluid in the second cartridge chamber 150 is directed into the fluid passage 140 in the receiver sub 104. The fluid passage 140 directs fluid into the drill string 14 and bottom hole assembly 22 downhole from the jar 100.

Turning to FIGS. 13A-13D, another embodiment of an elongate cartridge 450 is shown. The cartridge 450 is generally identical to the cartridge 146, with a few exceptions. The cartridge 450 comprises a first cartridge chamber 452 having a single port 454 formed therein. The port 454 opens at a first end 456 of the cartridge 450. The cartridge 450 further comprises a second cartridge chamber 458 situated below and isolated from the first cartridge chamber 452. The second cartridge chamber 458 opens at a second end 460 of the cartridge 450 and has at least two ports 462 formed therein. The ports 462 interconnect an outer surface of the cartridge 450 and the chamber 458. The isolated first and second cartridge chambers 452 and 458 function in the same manner as the cartridge chambers 148 and 150 formed in the cartridge 146.

Figure 13A:
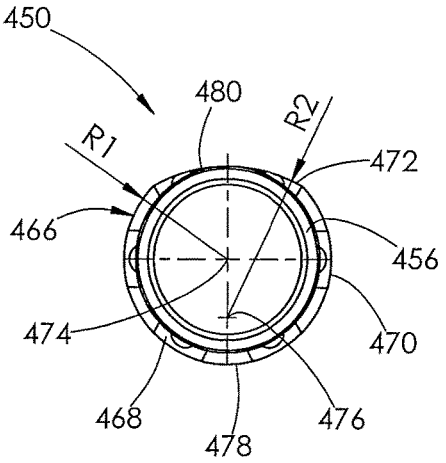
FIG. 13A is a plan view of another embodiment of an elongate cartridge.
Figure 13B:
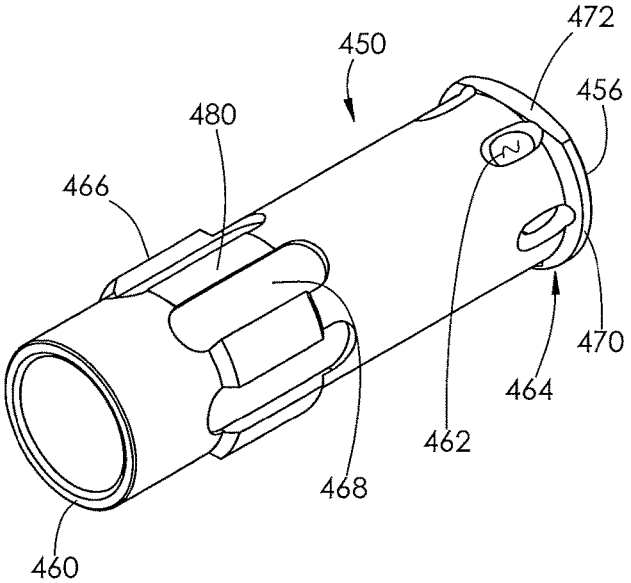
FIG. 13B is a perspective view of the cartridge shown in FIG. 13A.

Continuing with FIGS. 13A-13D, the cartridge 450 further comprise a flange 464 formed at its second end 460, and a plurality of shoulders 466 formed around its outer surface and surrounding the first cartridge chamber 452. Like the cartridge 146, the shoulders 466 are spaced apart so as to form fluid lanes 468 between adjacent shoulders 466. Also like the cartridge 146, the flange 464 and the shoulders 466 have the same or approximately the same outer diameter. In contrast to the cartridge 146, the flange 464 comprises a concentric portion 470 joined to a non-concentric portion 472. The concentric portion 470 comprises a generally cylindrical outer surface of the flange 464. The non-concentric portion 472 comprises a portion of the flange 464 that has been cut-away, as shown in FIG. 13B.

Continuing with FIG. 13A, the non-concentric portion 470 is non-concentric relative to the first end 456 of the cartridge 450, such that the concentric portion 470 has a first central longitudinal axis 474, and the non-concentric portion has a second central longitudinal axis 476. Thus, the concentric portion 470 comprises a radius, R1, and the non-concentric portion 472 comprises a radius, R2, as shown in FIG. 13A. R2 is greater than R1, as also shown in FIG. 13A.

Figure 13C:
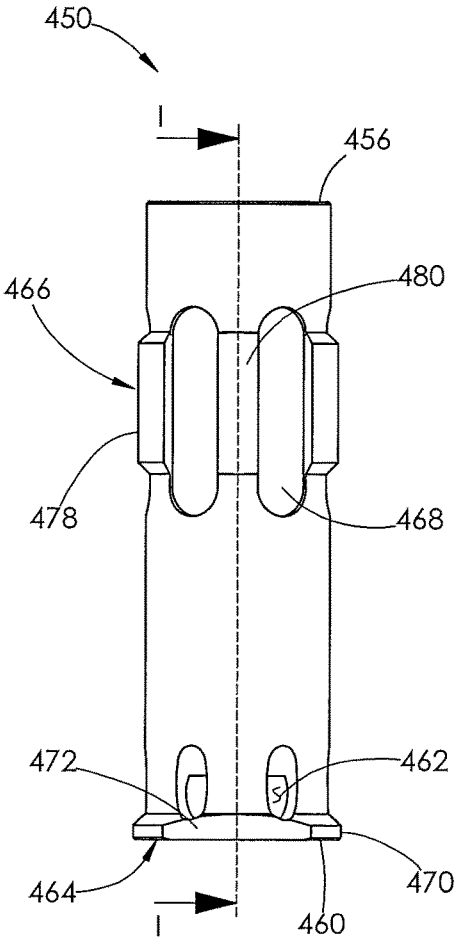
FIG. 13C is a side elevational view of the cartridge shown in FIGS. 13A and 13B.
Figure 13D:
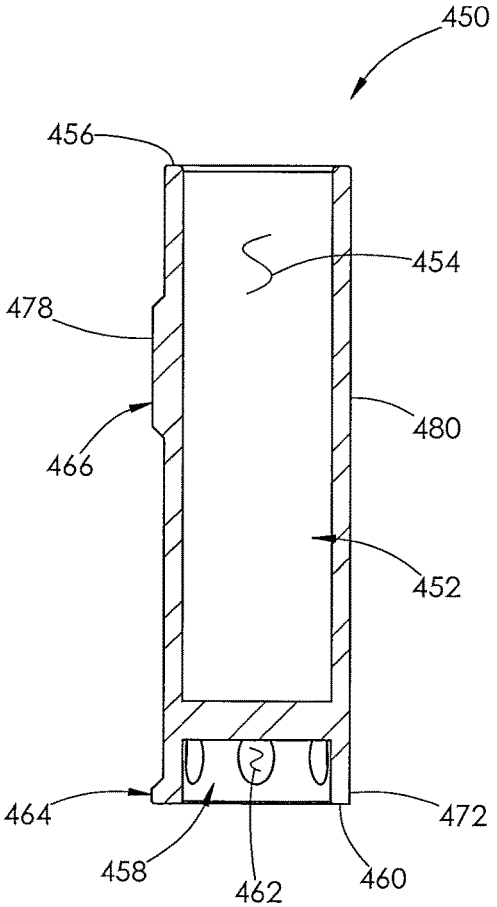
FIG. 13D is a cross-sectional view of the cartridge shown in FIG. 13C, taken along line I-I.

Continuing with FIG. 13B, the cartridge 450 is also different from the cartridge 146 because one of the plurality of shoulders 466 has been cut-away such that the shoulders 466 comprise a plurality of concentric shoulders 478 and at least one non-concentric shoulder 480. The plurality of concentric shoulders 478 are concentric with the concentric portion 470 of the flange 464 and have the first central longitudinal axis 474. The at least one non-concentric shoulder 480 is situated so as to have the second longitudinal axis 476. Thus, the concentric shoulders 478 have the radius, R1, and the non-concentric shoulder 480 has the radius R2, as shown in FIG. 13A. R2 is again greater than R1, as shown in FIG. 13A. The non-concentric portion 472 of the flange 464 and the at least one non-concentric shoulder 480 are aligned along a length of the cartridge 450, as shown in FIGS. 13C and 13D.

The non-concentric portion 472 of the flange 464 and the non-concentric shoulder 480 cause the cartridge 450 to have a non-circular cross-section, as shown in FIG. 13A. The non-circular cross-section of the cartridge 450 causes turbulent fluid flow around the cartridge 450 and within the receiver sub 104. The irregular fluid flow causes the cartridge 450 to oscillate within the receiver sub 104. This oscillation, or vibration, is transferred to downhole components and drill string 14 and/or the flowing fluid so as to further help free a stuck drill string 14.

In alternative embodiments, the cartridge 450 may be modified differently than as specifically described herein, but still in a manner that causes the cartridge to have one or more non-concentric portions. In further alternative embodiments, other components of the jar 100 or the jar 200, described below, may be modified so as to have non-concentric portions resulting turbulent fluid flow and vibration of the drill string 14.

Figure 14:
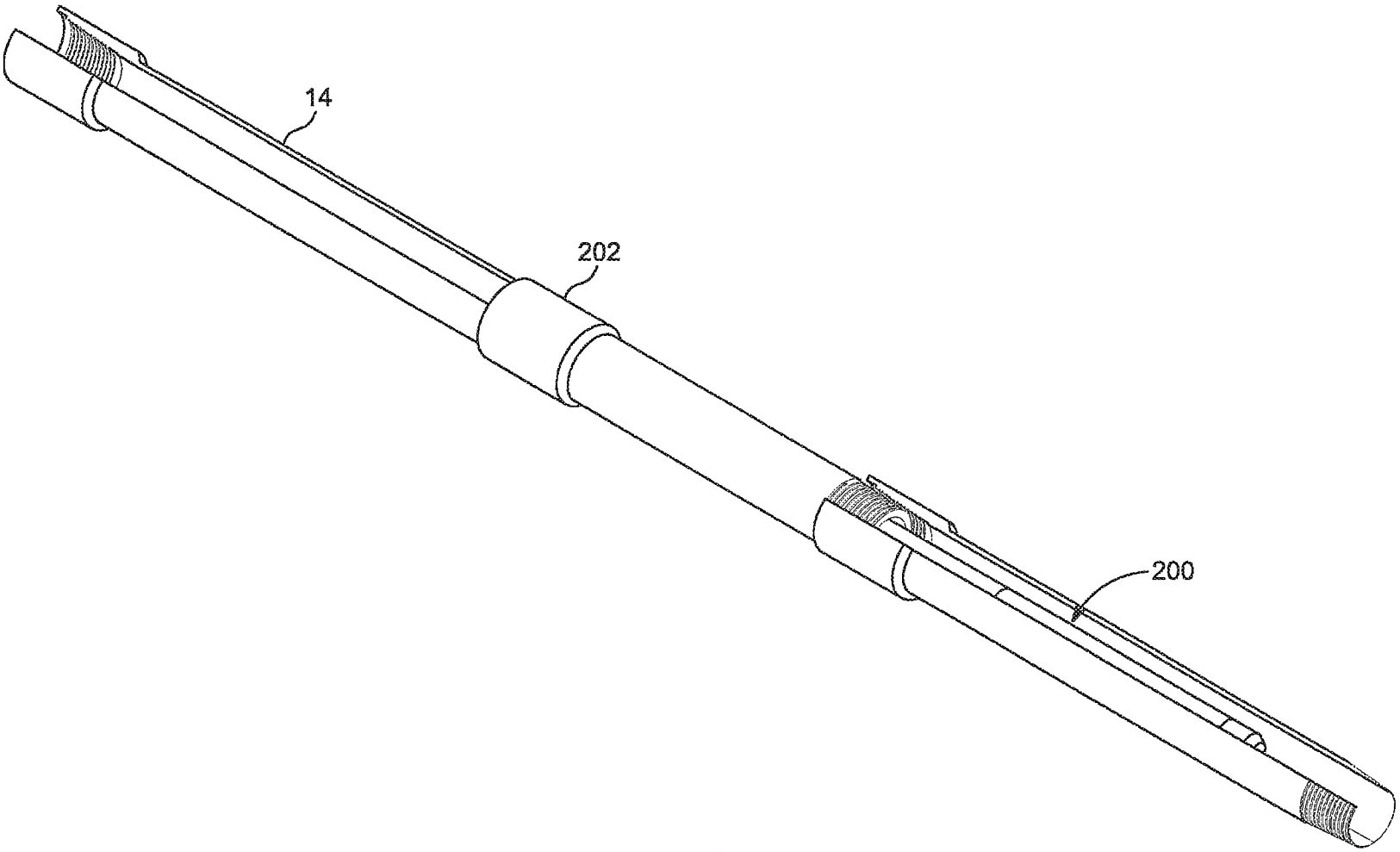
FIG. 14 is a perspective view of a portion of a drill string within which a second embodiment of a jar has been installed. For better display of components, portions of the drill string have been cut away.
Figure 15:
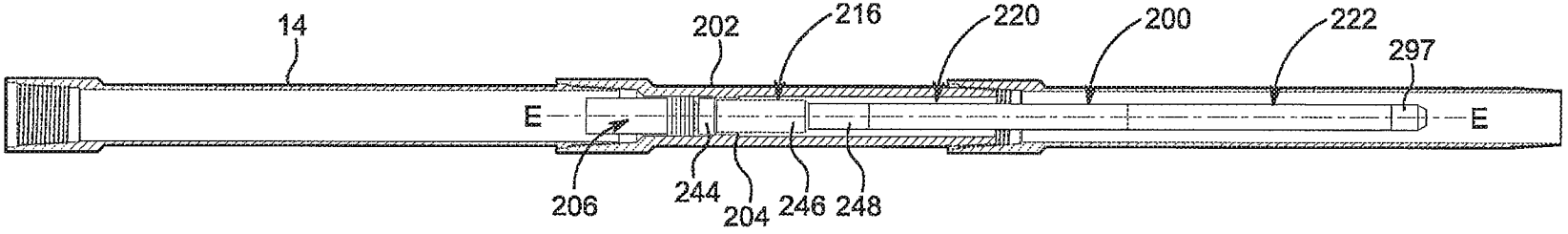
FIG. 15 is a cross-sectional view of the jar of FIG. 14, shown in an installed position within a drill string. A pump-down sub and a cross-over sub at the upper end of the jar engage a landing sub of the drill string.
Figure 16:
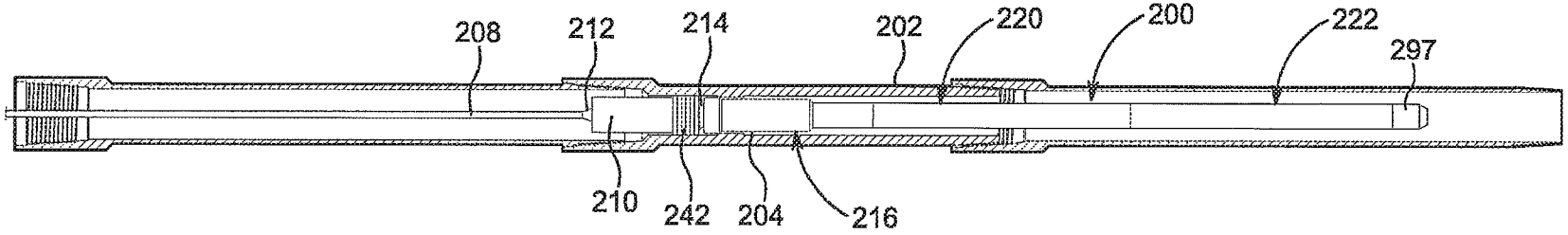
FIG. 16 is another cross-sectional view of the jar of FIG. 14, shown in a different installation configuration within a drill string. The jar is suspended within the drill string from a wireline.

Turning now to FIGS. 14-23, the jar 200 for use with a jointed pipe drill string 14 is shown in more detail. Unlike the jar 100, the jar 200 cannot be threaded directly into the drill string 14. The jar 200 forms a substring that is incorporated into a drill string 14 or bottom hole assembly 22, as shown in FIGS. 14-16. The jar 200 may be incorporated into the drill string 14 or bottom hole assembly 22 by using a landing sub 202 or a locking mandrel (not shown).

The landing sub 202 may be threaded into the drill string 14 or the bottom hole assembly 22 prior to starting drilling operations. The landing sub 202 is configured for receiving the jar 200. The landing sub 202 comprises an annular shoulder 204 (FIGS. 15-16) that stops the jar 200 from moving further down the drill string 14. A pump down sub 206 may be attached to the jar 200. The pump down sub 206 may be used to lower or pump the jar 200 down the drill string 14 until it engages with the landing sub 202.

If a landing sub 202 is not included in the drill string 14 already in the wellbore 20, the jar 200 may be attached to a locking mandrel and then pumped down the drill string 14. The locking mandrel may lock the jar 200 in a desired position within the drill string 14 or bottom hole assembly 22.

The jar 200 may also be sent down the drill string 14 on a wireline 208 (FIG. 16). If the jar 200 is sent down on a wireline 208, a wireline tool 210 is used in place of the pump down sub 206. The wireline tool 210 is attached to the wireline 208 on its first end 212 and the jar 200 on its second end 214. The wireline 208 extends between the tool 210 and the ground surface 18. The wireline 208 is used to lower or send the wireline tool 210 and the jar 200 down the drill string 14 until it engages with the landing sub 202.

Alternatively, a locking mandrel may be attached to the wireline tool 210 and jar 200. In this case, the wireline tool 210 sends the jar 200 and locking mandrel down the drill string 14 until they reach the desired position. Once in the desired position within the drill string 14 or bottom hole assembly 22, the locking mandrel may lock the jar 200 in place. The jar 200 may also be incorporated into the drill string 14 or bottom hole assembly 22 at the ground surface 18 prior to starting drilling operations.

Figure 17:
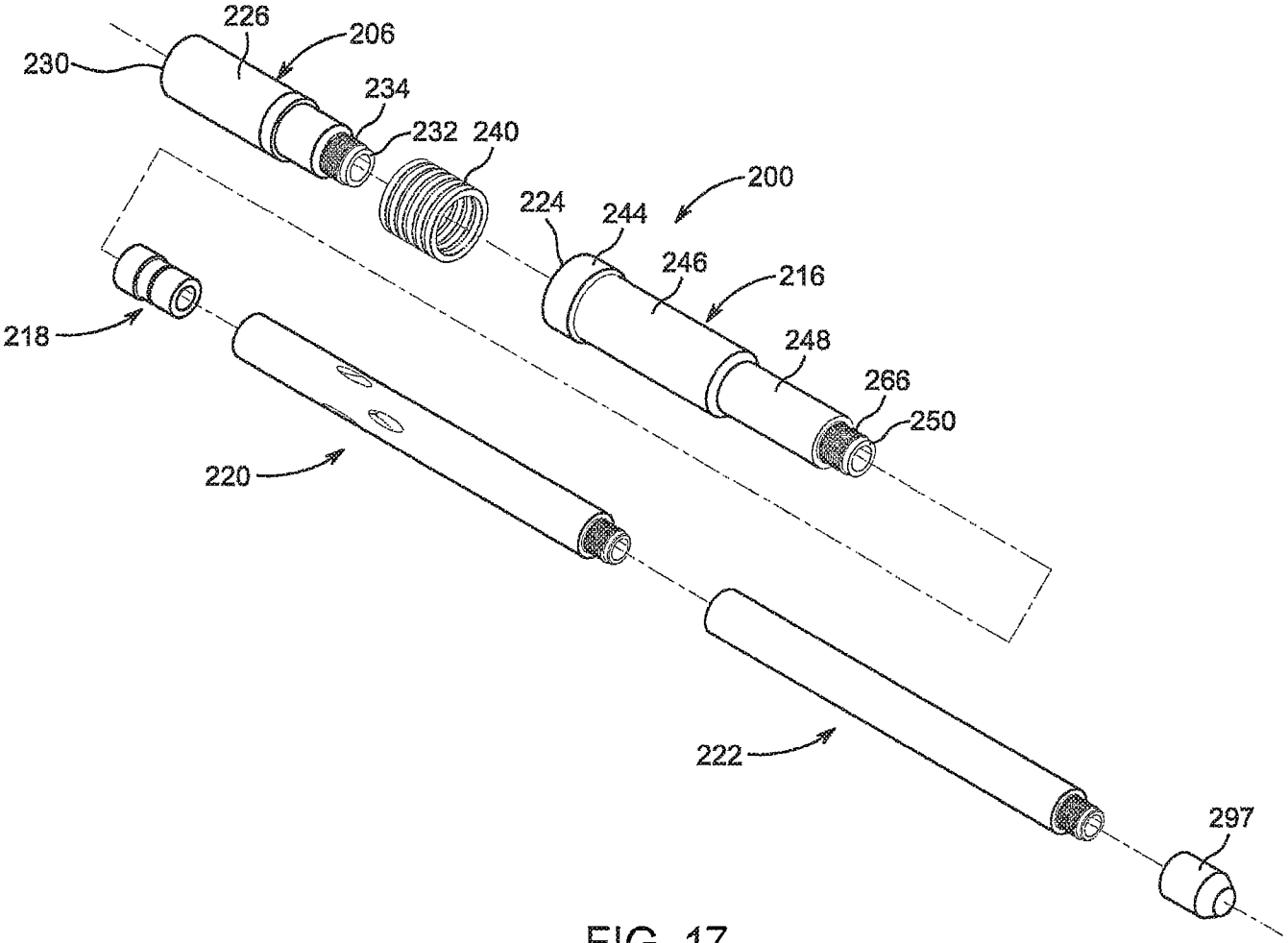
FIG. 17 is an exploded view of the jar shown in FIG. 15.
Figure 18:
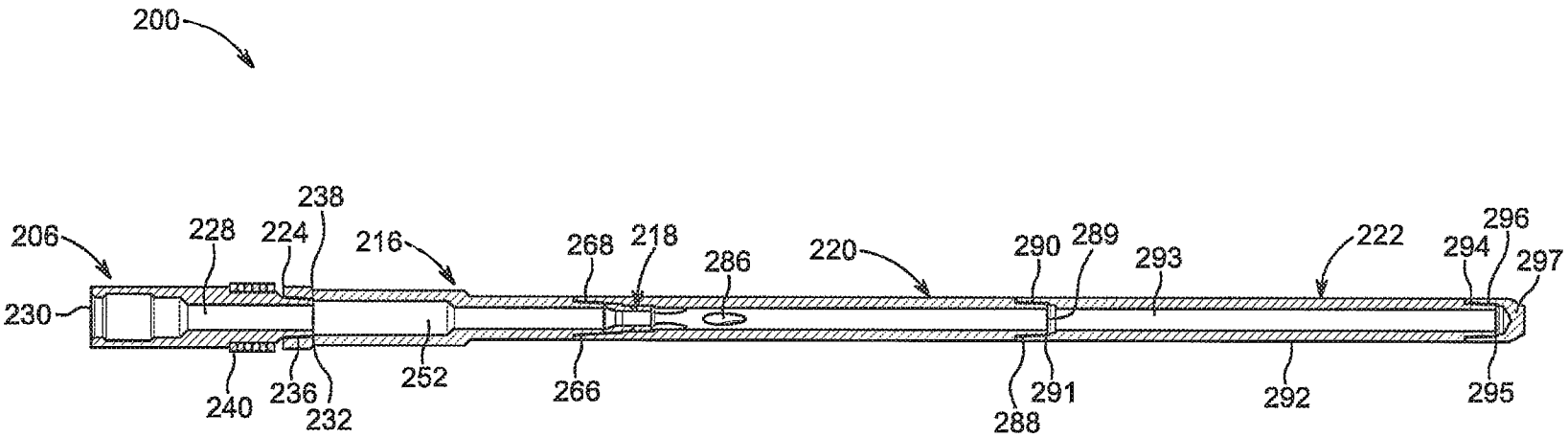
FIG. 18 is a cross-sectional view of the jar shown in FIG. 15, taken along line E-E.
Figure 19:
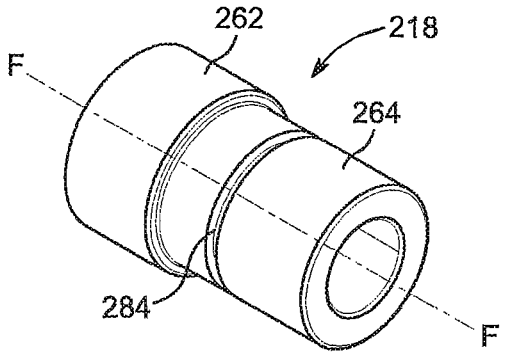
FIG. 19 is an enlarged perspective view of the funnel sub of the jar shown in FIGS. 17 and 18.

Turning to FIG. 17-18, the jar 200 is shown in more detail. FIG. 17 shows an exploded view of the jar 200 that includes the pump down sub 206. FIG. 18 is a cross-sectional view of the jar shown in FIG. 15, taken along line E-E. The pump down sub 206 is also shown attached to the jar 200 in FIG. 18. The jar 200 comprises a cross-over sub 216, a funnel sub 218, a fluid release sub 220, and a receiver sub 222. The subs 216, 218, 220, and 222 are attached end-to-end to one another to form a substring or the jar 200. The subs 216, 218, 220, and 222 are also all in fluid communication with one another when attached together.

The pump down sub 206 is shown attached to a first end 224 of the jar 200. The pump down sub 206 has a cylindrical outer body 226 with a longitudinal internal fluid passage 228 (FIG. 18). The fluid passage 228 opens at a first end 230 and an opposite second end 232 of the pump down sub 206. A set of external threads 234 are formed on the second end 232 of the pump down sub 206. The external threads 234 engage with internal threads 236 formed in a first end 238 of the cross-over sub 216 (FIG. 18).

A set of seals or vee packing 240 is disposed around the body 226 of the pump down sub 206 proximate its second end 232. Once the jar 200 is engaged with the landing sub 202, the vee packing 240 helps seal fluid from entering the space between the jar 200 and the drill string 14. This helps maintain hydraulic pressure within the drill string 14. The wireline tool 210 may also have vee packing 242 (FIG. 16) around its outer body to help maintain hydraulic pressure within the drill string 14. Similarly, if a locking mandrel is used in place of the landing sub 202, the locking mandrel may have vee packing disposed around its outer body to help maintain hydraulic pressure within the wellbore 20.

The cross-over sub 216 is used to engage with the landing tool 202 or a locking mandrel. The outer surface of the cross-over sub 216 has a top flange 244, a middle section 246, and a bottom section 248. The top flange 244 is formed proximate the first end 238 of the cross-over sub 216 and has a greater diameter than the middle section 246. The middle section 246 has a greater diameter than the bottom section 248. The bottom section 248 is formed proximate a second end 250 of the cross-over sub 216. As shown in FIGS. 15-16, the middle section 246 will engage with the annular shoulder 204 in the landing sub 202, and the top flange 244 will prevent the cross-over sub 216 from moving past the annular shoulder 204. The cross-over sub 216 may vary in size and diameter depending on the size of the landing sub 202 used during drilling operations. If a locking mandrel is used in place of the landing sub 202, the cross-over sub 216 may thread onto the end of the locking mandrel.

The cross-over sub 216 has a longitudinal internal fluid passage 252 that opens at its first end 224 and its opposite second end 250. The fluid passage 252 is in-line with the fluid passage 228 formed in the pump down sub 206. Fluid from the pump down sub 206 passes into the fluid passage 252 of the cross-over sub 216. Alternatively, the wireline tool 210 may have a fluid passage (not shown) to pass fluid between the tool 210 and the cross-over sub 216. Likewise, fluid may pass from a passage in the locking mandrel into the cross-over sub 216.

Figure 20:
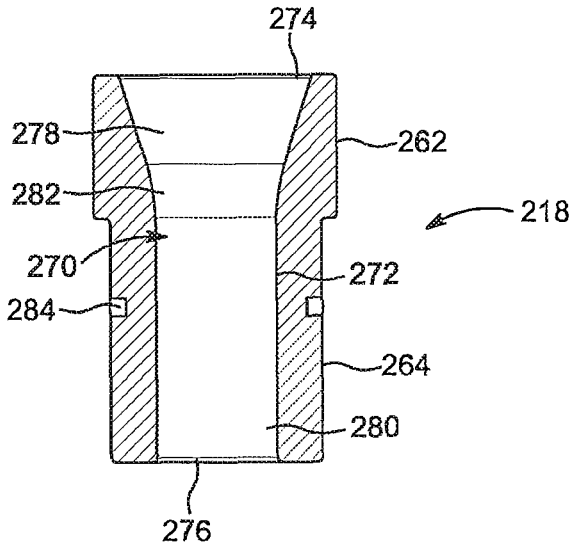
FIG. 20 is a cross-sectional view of the funnel sub shown in FIG. 19, taken along a plane that contains line F-F.
Figure 21:
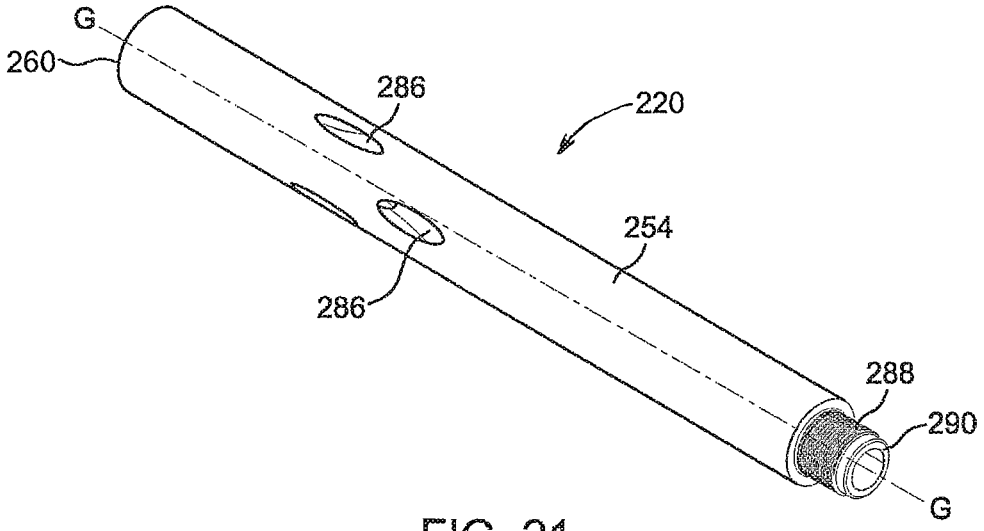
FIG. 21 is an enlarged perspective view of a fluid release sub of the jar shown in FIGS. 17 and 18.
Figure 22:
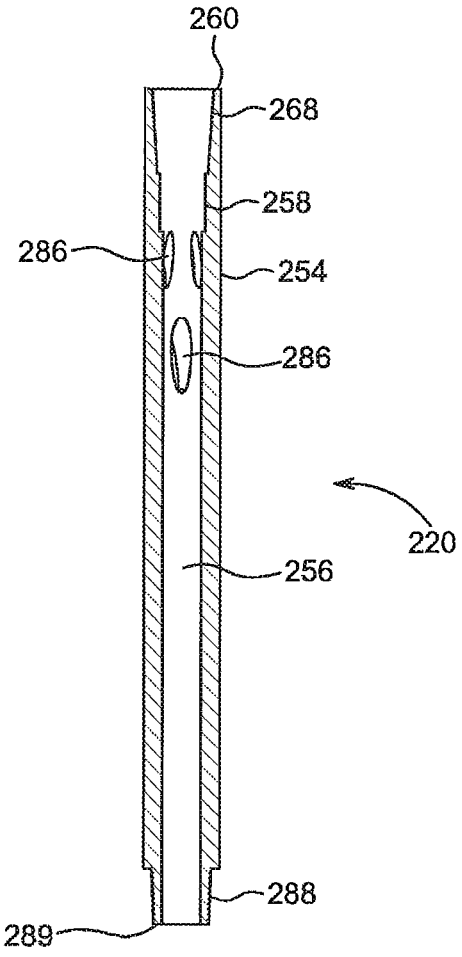
FIG. 22 is a cross-sectional view of the fluid release sub shown in FIG. 21, taken along a plane that contains line G-G.

Turning now to FIGS. 19-22, the funnel sub 218 and fluid release sub 220 are shown in more detail. The fluid release sub 220 has a cylindrical outer body 254 and a longitudinal internal fluid passage 256. The fluid passage 256 is shown in FIG. 22. FIG. 22 is a cross-section of the fluid release sub shown in FIG. 21, taken along a plane that includes line G-G. An annular shoulder 258 is formed in the fluid passage 256 proximate a first end 260 of the fluid release sub 220. The funnel sub 218 sits inside of the fluid passage 256 formed in the fluid release sub 220. The annular shoulder 258 prevents the funnel sub 218 from moving farther down the fluid passage 256.

The outer surface of the funnel sub 218 has a top flange 262 and a bottom section 264. The top flange 262 has a greater diameter than the bottom section 264. When the funnel sub 218 is in the fluid passage 256 of the fluid release sub 220, the bottom section 264 of the funnel sub 218 engages with the annular shoulder 258 and the top flange 262 prevents the funnel sub 218 from moving past the annular shoulder 258. The cross-over sub 216 has a set of external threads 266 that engage with internal threads 268 on the fluid release sub 220 (FIG. 22). The cross-over sub 216 secures the funnel sub 218 in place within the fluid release sub 220 by threading into the internal threads 268 in the fluid release sub 220, as shown in FIG. 18.

Like jar 100, a funnel element 270 is formed inside of the funnel sub 218. The funnel element 270 is shown in FIG. 20. FIG. 20 is a cross-section the funnel sub of FIG. 19, taken along a plane that includes line F-F. The funnel element 270 has a fluid passage 272 that opens at a first surface 274 and an opposite second surface 276. The first surface 274 opens into an enlarged and recessed bowl 278. The bowl 278 tapers inwardly and connects with a narrow neck 280 that opens at the second surface 276 of the funnel element 270. The bowl 278 has the shape of a frustum of a right circular cone having a slant angle of between 15 and about 20 degrees. Preferably this angle is 17.5 degrees. The connection between the bowl 278 and the narrow neck 280 forms a seat 282.

When the funnel sub 218 is in the fluid release sub 220, fluid from the cross-over sub 216 passes through the funnel element 270 and into the fluid release sub 220. An O-ring or a seal 284 may be disposed around the bottom section 264 of the funnel sub 220 to prevent fluid from passing around the outer surface of the funnel sub 218 and into the fluid release sub 220. This helps maintain hydraulic pressure within the drill string 14.

Referring now to FIGS. 21-22, the fluid release sub 220 has a plurality of fluid vents 286 that extend from the fluid passage 256 to its outer body 254. When fluid enters the fluid release sub 220 after passing through the funnel element 270, it may be expelled through the fluid vents 286. Fluid released from the fluid release sub 220 re-enters the drill string 14 (FIGS. 14-16).

The fluid release sub 220 further comprises a set of external threads 288 formed on its second end 289. The external threads 288 engage with internal threads 290 formed in a first end 291 of the receiver sub 222 (FIG. 18). The receiver sub 222 has a cylindrical outer body 292 and a longitudinal internal receiver chamber 293. The receiver sub 222 further comprises a set of external threads 294 formed on its second end 295. The external threads 294 engage with internal threads 296 formed in an end cap 297. The receiver chamber 293 terminates at the end cap 297. The receiver chamber 293 is in fluid communication with the fluid passage 256 of the fluid release sub 220.

Figure 23:
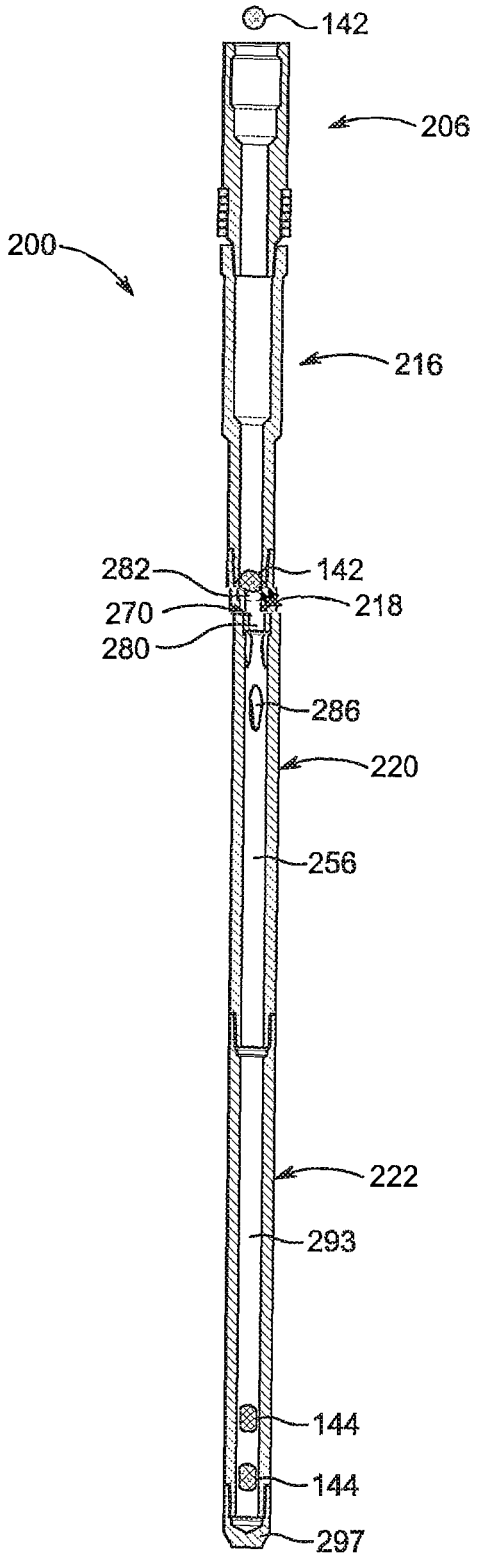
FIG. 23 shows how the deformable ball is positioned relative to the jar of FIG. 18 at successive stages of the jarring process.

Turning now to FIG. 23, activation of the jar 200 is shown in greater detail. Once the jar 200 is set in place within the drill string 14 or bottom hole assembly 22, the jar 200 may be activated. The same balls 142, 144 and operation described with reference to jar 100 may be used with jar 200. Like jar 100, to activate the jar 200, a deformable ball 142 is sent down the drill string 14. The ball 142 is stopped once it reaches the seat 282 formed in the funnel element 270. The ball 142 prevents fluid from passing from the funnel sub 218 into the fluid release sub 220. Hydraulic pressure builds on the ball 142 until it exceeds the pressure the ball can withstand. Once the pressure the ball 142 can withstand is exceeded, the ball will deform and be expelled through the narrow neck 280 of the funnel element 270. The deformed ball 144 will pass through the fluid passage 256 of the fluid release sub 220 and be captured within the receiver chamber 293 of the receiver sub 222.

As the deformed ball 144 is expelled through the narrow neck 280 of the funnel element 270, fluid will rapidly release from the funnel element 270 into the fluid release sub 220. As discussed with reference to jar 100, the rapid release of fluid will cause a dynamic event in the wellbore 20. The dynamic event is characterized by the powerful jarring or jolting of the drill string 14 or bottom hole assembly 22 to dislodge the drill string 14 or bottom hole assembly 22 from its stuck point within the wellbore 20. This process may be repeated as many times as needed until the drill string 14 or bottom hole assembly 22 is dislodged from its stuck point within the wellbore 20.

Fluid released into the fluid passage 256 of the fluid release sub 220 may pass through the fluid vents 286 and back into the drill string 14. The fluid vents 286 are tear-shaped. The tear-shape allows fluid to pass through the vents 286, but not the deformed balls 144. The tear-shape also prevents deformed balls 144 from getting lodged within the vents 286 and blocking the flow of fluid. The deformed balls 144 may only pass from the funnel element 270 into the fluid release sub 220 and into the receiver sub 222. Fluid that is passed back into the drill string 14 from the vents 286 may flow around the outer surface of the receiver sub 222 and continue through the drill string 14, as shown in FIGS. 14-16.

Turning now to FIGS. 24-26, the jar 300 for use with the coiled tubing system 26 (FIG. 2) is shown in more detail. The jar 300 comprises a funnel element 302 and a collar element 304. The collar element 304 has a cylindrical outer body 306 that opens at a first end 308 and an opposite second end 310. The first end 308 of the collar element 304 attaches to the end of a coiled tubing drill string 30. The first end 308 of the collar element 304 may be welded onto the end of a coiled tubing drill string 30. Alternatively, a set of slips may be used to grip and hold the coiled tubing 30 and the first end 308 together.

The second end 310 of the collar element 304 has a set of external threads 312. The external threads 312 may thread onto internal threads (not shown) formed in a bottom hole assembly 36 used in coiled tubing operations 26. The collar element 304 is attached to the coiled tubing drill string 30 and bottom hole assembly 36 prior to starting coiled tubing drilling operations 26.

If the coiled tubing drill string 30 or bottom hole assembly 36 becomes stuck within the wellbore 20 during operations, the jar 300 may be assembled. To assemble the jar 300, the funnel element 302 is first lowered or pumped down the coiled tubing drill string 30. The funnel element 302 has an elongated tapered outer surface 314. The funnel element 302 may fit within the collar element 304 by entering the first end 308 of the collar element 304. The collar element 304 is configured to hold the funnel element 302 in place within the coiled tubing string 30.

To pump the funnel element 302 down the coiled tubing drill string 30, the funnel element 302 may be inserted into an end 31 of the coiled tubing drill string 30 at the ground surface 18 (FIG. 2). The funnel element 302 may be pumped through the entire spool 28 of coiled tubing 30 on the reel 32 at the ground surface 18 until the funnel element 302 enters the coiled tubing drill string 30 within the wellbore 20. The funnel element 302 will be pumped down the drill string 30 in the wellbore 20 until the funnel element 302 reaches the collar element 304. The funnel element 302 may also be incorporated into the collar element 304 prior to starting drilling operations.

Turning now to FIGS. 25-26, the jar 300 is shown in more detail. FIG. 25 is a perspective view of the funnel element 302 installed within the collar element 304. Portions of the funnel element 302 and the collar element 304 have been cut away, for better display. FIG. 25 is a cross-sectional view of the funnel element 302 within the collar element 304. The cross-section is taken along line H-H shown in FIG. 24. The collar element 304 has an internal midpoint 316. A shelf 318 (FIG. 25) is formed around the internal circumference of the collar element 304 at the midpoint 316. The coiled tubing drill string 30 enters the first end 308 of the collar element 304 and engages with the shelf 318. Below the midpoint 316 starts a centrally disposed collar passage 320. The collar passage 320 opens at a first surface 322 within the collar element 304 and at the second end 310 of the collar element 304. The first surface 322 opens at an annular shoulder 324 that tapers inwardly. The annular shoulder 324 connects to a neck 326 that opens at the second end 310 of the collar element 304.

The funnel element 302 will pass through the collar element 304 until it reaches the midpoint 316. When the funnel element 302 reaches the midpoint 316 the tapered outer surface 314 of the funnel element 302 will engage with the annular shoulder 324 of the collar passage 320. As the funnel element 302 moves down the collar passage 320 it will become lodged within the collar passage 320. This occurs because the upper portion of the funnel element 302 has a greater diameter than the neck 326 of the collar passage 320. Hydraulic pressure within the coiled tubing drill string 30 will keep the funnel element 302 lodged within the collar passage 320 during operation.

Like the jar 100 and 200, the funnel element 302 of the jar 300 has an internal fluid passage 328 that opens at a first surface 330 and an opposite second surface 332. The first surface 330 opens into an enlarged and recessed bowl 334. The bowl 334 tapers inwardly and connects with a narrow neck 336 that opens at the second end 332 of the funnel element 302. The bowl 334 has the shape of a frustum of a right circular cone having a slant angle of between 15 and about 20 degrees. Preferably this angle is 17.5 degrees. The connection between the bowl 334 and the narrow neck 336 forms a seat 338.

Once the jar 300 is assembled, the jar 300 may be activated. Like the jar 100 and 200, the jar 300 is activated by pumping a deformable ball 142 down the drill string 30. The same balls 142, 144 and operation described with reference to jars 100 and 200 may be used with the jar 300. The ball 142 is stopped once it reaches the seat 338 formed in the funnel element 302. The ball 142 prevents fluid from passing from the funnel element 302 into the collar passage 320 of the collar element 304. Hydraulic pressure builds on the ball 142 until it exceeds the pressure the ball can withstand. Once the pressure the ball 142 can withstand is exceeded, the ball will deform and be expelled through the narrow neck 336 of the funnel element 302. The deformed ball 144 will pass through collar passage 320 of the collar element 304 and may be retained within the bottom hole assembly 36. A screen (not shown) may be incorporated into the bottom hole assembly 36 to retain the deformed balls 144 but allow fluid to pass through. Alternatively, the deformed ball 144 may be expelled through the bottom hole assembly 36 and into the wellbore 20.

As the deformed ball 144 is expelled through the narrow neck 336 of the funnel element 302, fluid will rapidly release from the funnel element 302 into the collar passage 320 of the collar element 304 and into the bottom hole assembly 36. As discussed with reference to jar 100 and 200, the rapid release of fluid will cause a dynamic event in the wellbore 20. The dynamic event is characterized by the powerful jarring or jolting of the coiled tubing drill string 30 or bottom hole assembly 36 to dislodge the drill string 30 or bottom hole assembly 36 from its stuck point within the wellbore 20. This process may be repeated as many times as needed until the coiled tubing drill string 30 or bottom hole assembly 36 is dislodged from its stuck point within the wellbore 20.

The jars 100, 200, and 300 may be made of steel, aluminum, plastic, carbon fiber or other materials suitable for use in oil and gas operations. Preferably the jars 100, 200, and 300 are made of steel. The jars 100, 200, and 300 may also be covered in tungsten nitrate to harden the outer surface and help prevent the jars from rusting over time. Loctite may also be used on the threads on jars 100, 200, and 300. The Loctite helps secure the threaded connections to prevent the jars 100, 200, and 300 from becoming unthreaded during operation. Each of the jars 100, 200, and 300 may be easily disassembled and contained within a handheld carrying case.

A jar 100, 200, 300 may be assembled from a kit. Such a kit should include at least one funnel element 122, 270, 302, and at least one, and preferably a plurality of deformable balls 142. In some embodiments, the kit may further include at least one collar element 304.

In other embodiments, the funnel element 122, 270 of the kit may be incorporated into a funnel sub 102, 218 and the kit may further include a receiver sub 104, 222. Such a kit may also include at least one fluid release sub 220.

Although the preferred embodiment has been described in detail, it should be understood that various changes, substitutions and alterations can be made therein without departing from the spirit and scope of the invention as defined by the appended claims.

The invention claimed is:

1. A method of using a drill string configured for use within an underground environment, the method comprising:

incorporating a sub having a fluid passage formed therein into the drill string, the sub having an elongate cartridge installed within the fluid passage, the cartridge retained within the fluid passage, but movable relative to the sub and having an outer surface comprising a first portion joined to a second portion, wherein the first portion has a first center of curvature substantially located at a central axis of the fluid passage, and wherein the second portion has a second center of curvature spaced apart from the central axis of the fluid passage;

lowering a portion of the drill string carrying the sub into the underground environment; and generating fluid flow within the drill string and around the elongate cartridge such that the fluid flow causes the elongate cartridge to oscillate within the sub.

2. The method of claim 1, in which the sub is characterized as a receiver sub, and in which a funnel sub having a fluid passage formed therein is also incorporated into the drill string and attached to the receiver sub, the method further comprising:

blocking a first end of the fluid passage within the funnel sub with a deformable ball;

increasing fluid pressure on the deformable ball within the drill string such that the following actions take place in response to the increased fluid pressure on the deformable ball:

the ball deforms and expels from a second end of the fluid passage within the funnel sub;

pressurized fluid rapidly releases through the fluid passage formed within the funnel sub; and the drill string jars.

3. The method of claim 1, in which the first portion of the outer surface of the elongate cartridge has a radius, R1, and the second portion of the outer surface of the elongate cartridge has a radius, R2;

and in which R2 is greater than R1.

4. The method of claim 3, in which R1 and R2 are formed on a flange positioned at an end of the elongate cartridge.

5. A kit, comprising:

a funnel sub having opposed first and second surfaces joined by a first fluid passage, the first fluid passage having a seat formed therein;

at least one deformable ball, each of which is sized, in its undeformed state, to be blocked from passing through the first fluid passage by the seat;

a receiver sub having opposed first and second surfaces joined by a second fluid passage; and an elongate cartridge sized for removable installation within the second fluid passage of the receiver sub, the cartridge having a pair of isolated cartridge chambers formed therein, in which one of the isolated cartridge chambers is configured to receive and retain deformed balls expelled from the funnel sub, the cartridge further having an outer surface comprising a first portion joined to a second portion, wherein the first portion has a first center of curvature substantially located at a central axis of the fluid passage, and wherein the second portion has a second center of curvature spaced apart from the central axis of the fluid passage.

6. The kit of claim 5, in which the seat is formed by an enlarged and recessed bowl connected to a narrow neck formed within the walls of the funnel sub surrounding the first fluid passage.

7. A method of using the kit of claim 5, comprising:

attaching the funnel sub to the receiver sub, the receiver sub having the cartridge installed therein;

incorporating the funnel sub and the receiver sub into a drill string, the drill string comprising a plurality of pipe sections joined together;

generating fluid flow within the drill string and around the elongate cartridge such that the fluid flow causes the elongate cartridge to oscillate within the sub.

8. A method of using the kit of claim 5, comprising:

attaching the funnel sub to the receiver sub, the receiver sub having the cartridge installed therein;

incorporating the funnel sub and the receiver sub into a drill string, the drill string comprising a plurality of pipe sections joined together;

sending one of the deformable balls down the drill string until the deformable ball is positioned on the seat; and increasing fluid pressure within the drill string until the deformable ball is deformed and expelled from the funnel sub.

9. The method of claim 8, further comprising:

releasing pressurized fluid rapidly from the funnel sub as the ball is expelled; and jarring the drill string as the ball is expelled from the funnel sub.

10. The kit of claim 5, in which the pair of isolated cartridge chambers comprise:

a first cartridge chamber having a single port formed therein, the single port configured to receive and retain deformed balls expelled from the funnel sub; and a longitudinally offset second cartridge chamber having at least two ports formed therein.

11. The kit of claim 5, in which a plurality of shoulders are formed on the outer surface of the cartridge such that the shoulders surround one of the isolated cartridge chambers, each shoulder spaced from an adjacent shoulder such that a fluid lane is formed between adjacent shoulders.

12. The kit of claim 11, in which at least one shoulder is aligned with the second portion of the outer surface of the cartridge.

13. The kit of claim 5, in which a flange is formed at an end of the cartridge; and in which the first portion and the second portion of the outer surface of the cartridge are formed on an outer surface of the flange.

14. The kit of claim 13, in which the first portion of the outer surface of the flange has a radius, R1, and the second portion of the outer surface of the flange has a radius, R2; and in which R2 is greater than R1.

15. A jarring tool, comprising:

a funnel sub having opposed first and second surfaces joined by a first fluid passage, the first fluid passage having a seat formed therein;

a receiver sub attached to the funnel sub and having opposed first and second surfaces joined by a second fluid passage; and an elongate cartridge installed within at least a portion of the second fluid passage of the receiver sub such that the cartridge is retained within the receiver sub but is movable relative to the receiver sub, the cartridge comprising:

a first cartridge chamber formed within the cartridge and opening towards the first surface of the receiver sub, the first cartridge chamber having a single port formed therein;

a second cartridge chamber formed within the cartridge and opening towards the second surface of the receiver sub, the second cartridge chamber isolated from the first cartridge chamber and having at least two ports formed therein; and a flange formed at an end of the cartridge and surrounding the second cartridge chamber; in which an outer surface of the flange comprises a first portion joined to a second portion wherein the first portion has a first center of curvature substantially located at a central axis of the second fluid passage, and wherein the second portion has a second center of curvature spaced apart from the central axis of the second fluid passage.

16. A kit, comprising:

the jarring tool of claim 15; and at least one deformable ball, each of which is sized, in its undeformed state, to be blocked from passing through the first fluid passage by the seat.

17. The jarring tool of claim 15, in which the seat is formed by an enlarged and recessed bowl connected to a narrow neck formed within the walls of the funnel sub surrounding the first fluid passage.

18. A system, comprising:

a wellbore formed within the ground;

a drill string installed within the wellbore, the drill string comprising a plurality of drill pipe sections joined together; and the jarring tool of claim 15 incorporated into the drill string.

19. A method of using the jarring tool of claim 15, comprising:

incorporating the jarring tool into a drill string, the drill string comprising a plurality of pipe sections joined together;

generating fluid flow within the drill string and around the elongate cartridge such that the fluid flow causes the elongate cartridge to oscillate within the sub.

20. The jarring tool of claim 15, in which the first portion of the outer surface of the flange has a radius, R1, and the second portion of the outer surface of the flange has a radius, R2; and in which R2 is greater than R1.

21. The jarring tool of claim 15, in which a plurality of shoulders are formed on an outer surface of the cartridge such that the shoulders surround the first cartridge chamber, each shoulder spaced from an adjacent shoulder such that a fluid lane is formed between adjacent shoulders.

22. The jarring tool of claim 21, in which at least one of the plurality of shoulders aligns with the second portion of the outer surface of the flange.

* * * * *